US006141525A

United States Patent [19]

Tahara

[11] Patent Number: 6,141,525

[45] **Date of Patent: *Oct. 31, 2000**

[54] IMAGE FORMING APPARATUS HAVING CORRECTION DEVICE FOR LATERAL MISALIGNMENT

[75] Inventor: Motoaki Tahara, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/637,345

[22] Filed: Apr. 25, 1996

[30] Foreign Application Priority Data

Apr. 28, 1995 [JP] Japan ..... 7-106486
Jun. 29, 1995 [JP] Japan ..... 7-186282

[51] Int. Cl.[7] ..... G03G 15/00

[52] U.S. Cl. ..... 399/395; 399/303; 399/313

[58] Field of Search ..... 355/212, 271, 355/326, 327; 399/395, 298, 299, 303, 312, 313, 314, 388; 198/806, 807; 474/102, 103

[56] References Cited

U.S. PATENT DOCUMENTS 4,557,372 12/1985 Rajagopal ..... 198/807
5,017,969 5/1991 Mitomi et al. ..... 355/271
5,027,160 6/1991 Okada et al. ..... 355/282
5,225,877 7/1993 Wong ..... 355/212
5,248,027 9/1993 Kluger et al. ..... 198/502.4
5,510,877 4/1996 DeJong et al. ..... 355/208
5,754,932 5/1998 Tahara ..... 399/303

FOREIGN PATENT DOCUMENTS 56-156544 12/1981 Japan .
57-60347 4/1982 Japan .

*Primary Examiner*—Robert Beatty
*Attorney, Agent, or Firm*—Fitzpatrick, Cella, Harper & Scinto

[57] ABSTRACT

The present invention provides an image forming apparatus which comprises a convey belt for bearing and conveying a recording material, an image forming device for forming an image on the recording material born on the convey belt, a detection device for detecting a position of the convey belt in a lateral direction to a conveying direction of recording material by the convey belt, a moving device for shifting the convey belt in the lateral direction to the conveying direction of recording material, and a control device for effecting shifting operations of the moving device every predetermined time by plural timers on the basis of a detection output from the detection device to change a shifting direction of the convey belt in the lateral direction. Further, the control device will control the moving device according to the moving speed of the belt in the lateral direction.

35 Claims, 20 Drawing Sheets

IMAGE FORMING APPARATUS HAVING CORRECTION DEVICE FOR LATERAL MISALIGNMENT

BACKGROUND OF THE INVENTION

1. Field of the Invention

The present invention relates to an image forming apparatus having a convey belt for bearing and conveying a recording material. More particularly, it relates to an image forming apparatus which is suitable to be applied to a color copying machine, a laser beam printer and the like, in which images formed on a plurality of image bearing members are transferred onto a recording material born by a convey belt in a superimposed fashion.

2. Related Background Art

In the past, for example, there has been proposed a image forming apparatus in which a plurality of image forming units each having an image bearing members (such as a photosensitive drum) are disposed side by side and images formed on the image bearing members are successively transferred onto a recording material (recording sheet) born on a transfer belt, thereby forming a multi-color image. Such an image forming apparatus will now be briefly explained with reference to FIG. 9.

The image forming apparatus (color laser printer utilizing a Carlson electrophotographic method for forming a latent image) comprises a transfer material convey belt (convey means) 7 for conveying a transfer material (transfer sheet) 9, four image forming units Pa, Pb, Pc and Pd disposed side by side along a shifting direction of the transfer material convey belt 7, and a fixing means 10. The image forming units Pa to Pd include photosensitive drums 1*a*, 1*b*, 1*c* and 1*d*, charge means 2*a*, 2*b*, 2*c* and 2*d*, laser beam scanners 3*a*, 3*b*, 3*c* and 3*d*, developing means 4*a*, 4*b*, 4*c* and 4*d*, transfer means 5*a*, 5*b*, 5*c* and 5*d*, and cleaning means 6*a*, 6*b*, 6*c* and 6*d*, which means 2*a* to 2*d*, 3*a*to 3*d*, 4*a* to 4*d*, 5*a* to 5*d* and 6*a* to 6*d* are disposed around the respective photosensitive drums 1*a* to 1*d*.

In the first image forming unit Pa, the photosensitive drum 1*a* uniformly charged by the charge means 2*a* is exposed by a laser beam from the laser beam scanner 3*a*, thereby forming a latent image for a yellow color component of an original image on the photosensitive drum 1*a*. Thereafter, the latent image is visualized by the developing means 4*a* with yellow toner to form a toner image. Then, the toner image is transferred onto the transfer sheet 9 on the transfer material convey belt 7, by means of the transfer means 5*a*.

On the other hand, while the yellow tone image is being transferred onto the transfer sheet 9 by the transfer means 5*a*, in the second image forming unit Pb, a latent image for a magenta color component of the original image is formed on the photosensitive drum 1 by the laser beam scanner 3*b*, and, then, the latent image is developed by the developing means 4*b* with magenta toner to form a magenta toner image. When the transfer sheet 9 to which the toner image was transferred in the first image forming unit Pa reaches the transfer means 5*b* of the second image forming unit Pb, the magenta toner image is transferred onto a predetermined position on the transfer sheet 9.

Similarly, a cyan toner image and a black toner images are successively transferred onto the same transfer sheet 9. After four color toner images are transferred to the transfer sheet 9 in a superimposed fashion, the transfer sheet 9 is sent to the fixing means 10, where the toner images are fixed to the transfer sheet 9, thereby forming a full-color image. After the transferring operation, residual toner is removed from each of the photosensitive drums 1*a* to 1*d* by the respective cleaning means 6*a* to 6*d* for preparing for the next latent image formation.

By the way, in the color image forming apparatus having the above-mentioned construction, since the plurality of image forming units Pa to Pd are provided for different color toners, the image forming operation can be effected at a high speed, and, since the transferring processes of the image forming units Pa to Pd are effected along a straight path, a thick sheet or a transparent sheet can be used as the transfer sheet. To the contrary, there arises a problem that the registration between the different color toner images formed in the respective image forming units Pa to Pd and the transfer sheet 9 must be performed strictly. If the registration between the different color toner images with respect to the transfer sheet 9 is not performed strictly to cause the deviation (referred to as "regist-shift" hereinafter) between the images on the transfer sheet, a poor multi-color image having color deviation and/or change in color phase will be obtained.

The regist-shift is caused by the fact that the transfer material convey belt 7 is not moved straightly but is shifted toward one side out of predetermined areas of a drive roller 11, an idler roller 12 and an adjustment roller 13, 14 shown in FIG. 9 or is moved along a serpentine route. Such regist-shift becomes one of factors for the color deviation.

Conventionally, in the color image forming apparatus having the above-mentioned construction, in order to prevent the one-side shift of the belt, for example, the following methods have been proposed:

(a) A method for providing flanges on both longitudinal ends of the rollers such as the drive roller 11, idler roller 12 and the like.

(b) A method for providing so-called "crowns" on the rollers such as the drive roller 11, idler roller 12 and the like so that a diameter of a central portion of each roller becomes greater than diameter of longitudinal ends of the roller.

(c) A method for providing a sprocket on one longitudinal end of each roller and forming a series of perforations in one edge portion of the transfer material convey belt with a predetermined interval equal to a pitch between teeth of the sprocket.

However, in the above method (a), although a simple construction can be obtained, since the transfer material convey belt 7 is positioned by urging the longitudinal edges of the belt against the flanges, the longitudinal edges of the belt are always subjected to thrust forces, with the result that the longitudinal edges of the belt are easily deformed or damaged. Thus, it is difficult to maintain the stable movement of the belt for a long time. In particular, in a transfer material convey belt made of organic material, it is desirable that a thickness of the belt is reduced as much as possible in order to improve the transferring efficiency. When the belt having the small thickness is used, since the belt edges have no strength, the belt can easily be damaged or destroyed, and, thus, cannot be used for a long time.

Such inconvenience will occur in the proposals disclosed in the Japanese Patent Publication Nos. 57-60347 (1982) and 56-156544 (1981) which utilize methods similar to the above method (a).

The above method (b) is a correction method which has been widely used. However, since the endless transfer material convey belt is flexed by the crowns of the rollers to generate internal stress, thereby preventing the one-side shift of the belt, the belt must be made of material having sufficient elasticity. In addition, since so-called permanent deformation of the belt due to creep strain must be prevented while utilizing the elastic deformation (strain), for example, when the belt is formed from rubber, not only rubber material having low hardness to provide adequate elasticity must be utilized, but also the thickness of the belt must be increased sufficient to provide predetermined mechanical strength. Thus, when the above method (b) is adopted to the transfer material convey belt 7, since the thickness of the transfer material convey belt 7 must be increased, the transfer current must also be increased. This is not preferable.

In the above method (c), as is in the above method (a), since the belt must have the required strength (particularly, anti-break strength) and the pitch accuracy of the sprocket teeth and the perforations greatly affects an influence upon the moving speed accuracy of the belt, high accurate moving speed control is required (for the transfer material convey belt 7). This is also not preferable.

In order to overcome the drawbacks of the above methods (a), (b) and (c), there was provided a method in which at least one of rollers among the rollers having axes perpendicular to a shifting direction of the transfer material convey belt 7 has a rotation axis having a variable angle with respect to the shifting direction of the transfer material convey belt 7.

In this method, a detection means for detecting one-side shift of the belt is provided, and, by changing the angle of the rotation axis of the roller on the basis of an output signal from the detection means, the one-side shift of the belt is corrected. This method is particularly effective to the belt having low elasticity and the effect of this method is not influenced upon the thickness of the belt.

However, according to the test results conducted by the Inventors, as shown in FIG. 9, in the image forming apparatus in which the plurality of photosensitive members are disposed side by side and the toner images formed on the photosensitive members are successively transferred onto the transfer sheet born on the transfer material convey belt, thereby forming a multi-color image, since the image is transferred onto the transfer sheet while the images are always being formed on the plural photosensitive members, after the one-side shift (offset) of the belt is detected by the detection means, if the moving direction of the belt is abruptly changed, it was found that the positions on which the different color toner images are to be transferred are also changed, with the result that the color deviation is caused along the direction perpendicular to the shifting direction of the belt, thereby worsening the image quality.

The present invention aims to eliminate such inconvenience.

SUMMARY OF THE INVENTION

An object of the present invention is to provide an image forming apparatus in which it is possible to prevent image-shift due to offset of a convey belt in a direction perpendicular to a recording material conveying direction.

Another object of the present invention is to provide an image forming apparatus in which a convey belt can be rotated, shifted or rocked to prevent image-shift on a recording material born by the convey belt.

A further object of the present invention is to provide an image forming apparatus in which a shifted movement of a convey belt can be controlled in accordance with a shifted speed of the belt.

The other objects and features of the present invention will be apparent from the following detailed explanation of the invention referring to the accompanying drawings.

DETAILED DESCRIPTION OF THE PREFERRED EMBODIMENTS

An embodiment of a image forming apparatus according to the present invention will now be explained with reference to the accompanying drawings.

Image Forming Process

Figure 4:
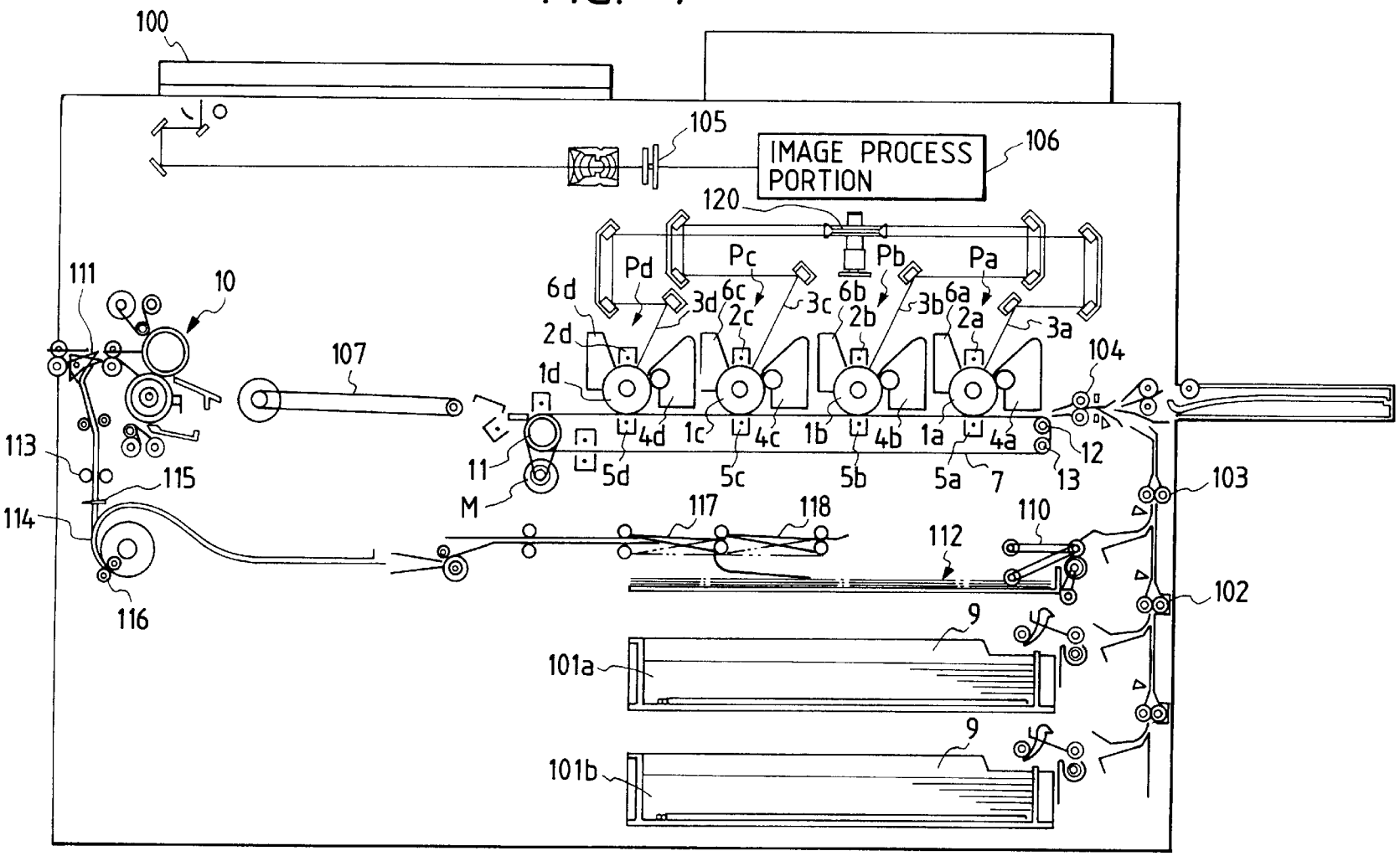
FIG. 4 is an explanatory view showing an image forming apparatus according to a preferred embodiment of the present invention.
Figure 9:
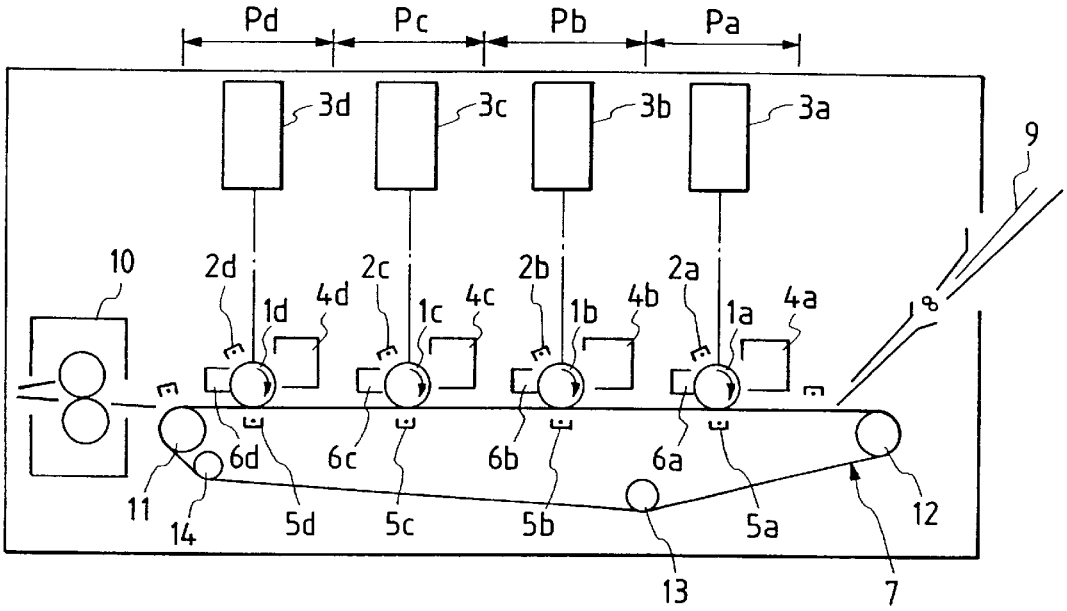
FIG. 9 PRIOR ART
FIG. 9 is a schematic illustration showing a conventional image forming apparatus.

FIG. 4 shows an image forming apparatus according to a preferred embodiment of the present invention. In this embodiment, the image forming apparatus is embodied as a color laser printer similar to the color image forming apparatus shown in FIG. 9. Therefore, elements having the same function are designated by the same reference numerals as those in FIG. 9 and the detailed explanation thereof will be omitted.

The color laser printer is an image forming apparatus for forming a full-color image by using four colors, i.e., yellow, magenta, cyan and black and includes four image forming units Pa, Pb, Pc and Pd which correspond to yellow, magenta, cyan and black, respectively and which are disposed side by side.

Figure 5:
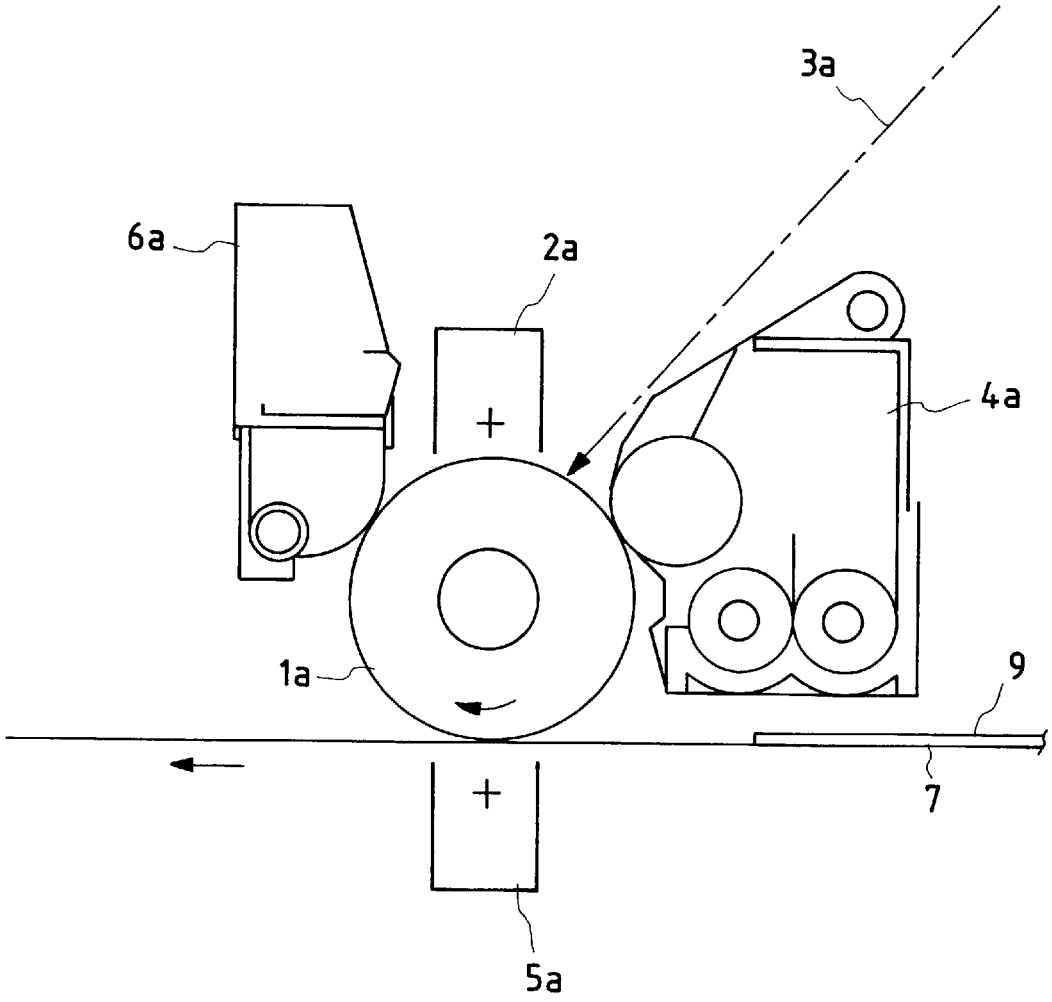
FIG. 5 is a enlarged view of an yellow image forming unit of the image forming apparatus of FIG. 4.

Now, an image forming process will be explained with reference to the yellow image forming unit Pa shown in FIG. 5 as an example. The yellow image forming unit Pa has a photosensitive drum (image bearing member) 1*a* which is uniformly charged by a first high voltage charger and grid high voltage unit 2*a*. After the charging, the photosensitive drum 1*a* is exposed by laser light 3*a* from a laser scanner 120 to form a latent image for an yellow image. Then, the latent image corresponding to the yellow image information is developed by a developing device 4*a* including yellow color toner to form an yellow toner image. The toner image is transferred onto a transfer material (transfer sheet) 9 born on a transfer material convey belt (transfer material convey means) 7 by a transfer charger 5*a*. Residual toner remaining on the yellow photosensitive drum 1*a* is removed by a cleaning device 6*a*. Incidentally, similar image forming processes are performed in the magenta, cyan and black image forming units Pb, Pc and Pd.

Both-Face Image Forming Sequence

A both-face image forming sequence of the laser printer having the above-mentioned construction will be described referring to an example that the transfer sheet is supplied from an upper cassette.

As soon as an image formation start signal is emitted, a first sheet supply roller solenoid (not shown) is turned ON so that the transfer sheet 9 starts to be supplied from a sheet supply cassette 101*a*. The transfer sheet 9 supplied from a sheet supply cassette 101*a* is conveyed by pairs of convey rollers 102, 103 to reach a first pair of regist rollers 104. The transfer sheet 9 is temporarily stopped when a predetermined loop is formed in the sheet after a tip end of the sheet abuts against a nip of the regist rollers 104.

On the other hand, at the same time when the image formation start signal is emitted, an original on a platen 100 is read by a CCD 105, and an image signal corresponding to the read image is sent to an image process portion 106. When image data read in an image memory of the image process portion 106 becomes a laser scan permitting condition, the first pair of regist rollers 104 start to be rotated. By rotation of the regist rollers, the transfer sheet 9 is conveyed to a predetermined position on the transfer material convey belt 7 and is adhered to there for image formation.

As mentioned above, the different color toner images are transferred onto the transfer sheet 9. In this case, the image information of the original is written on the photosensitive drums 1*a*, 1*b*, 1*c* and 1*d* in such timings that the toner images are successively transferred onto the transfer sheet 9 in a superimposed fashion when the transfer sheet 9 passes through the yellow, magenta, cyan and black image forming units Pa, Pb, Pc and Pd, respectively. The transfer sheet 9 which was passed through four image forming units Pa to Pd and to which four toner images were transferred in the superimposed fashion is then conveyed by a pre-fixing convey belt 107 to a fixing device 10, where the toner images are fixed.

On the other hand, in a both-face copy mode, at the same time when the image formation start signal is emitted, a sheet re-supply pick-up roller solenoid (not shown) is turned ON to lift a sheet re-supply roller 110 for both-face image formation. Further, a sheet convey path deflection plate solenoid (not shown) is also turned ON, with the result that a first sheet deflection plate 111 is operated to form a sheet convey path for the both-face image formation. At the same time, a sheet stopper solenoid (not shown) associated with an intermediate tray portion 112 is turned ON, with the result that a sheet stopper (not shown) in the intermediate tray portion is operated. After the fixing operation regarding a first surface of the transfer sheet is finished, the transfer sheet 9 is conveyed by the first sheet deflection plate 111 to a pair of convey rollers 113 through a both-face convey path.

When the transfer sheet 9 is passed through a sheet reverse rotation detection sensor 115 disposed in the vicinity of a switch-back portion (sheet reverse rotation portion) 114, a reversible roller 116 is rotated in a reverse direction. As a result, the transfer sheet 9 is switched-back to be conveyed to a second convey portion. Sheet size deflection plates 117, 118 serve to change the transfer sheet convey path to the intermediate tray 112 by driving a sheet deflection plate solenoid SL7 or SL8 (not shown). When the first transfer sheet 9 is conveyed into the intermediate tray portion, the sheet re-supply pick-up solenoid (not shown) is turned OFF temporarily, thereby lowering the rotating sheet re-supply roller 110 on the transfer sheet 9. As a result, the transfer sheet 9 abuts against a sheet stopper (not shown).

By the above-mentioned series of operations, the transfer sheets each having a first surface on which the image was formed are successively stacked on the intermediate tray 112 for preparation for second surface image formation.

In a condition that the sheet re-supply roller 110 is lowered and contacted with an upper surface of the transfer sheets 9 stacked on the tray 112, when a second surface image formation start signal is emitted, the second surface image formation is started. That is to say, a sheet re-supply clutch (not shown) is turned ON to rotate the sheet re-supply roller 110, thereby re-supplying one transfer sheet 9 in the tray 112 from an uppermost one. When the first transfer sheet 9 is re-supplied, the sheet re-supply roller 110 is lifted. And, when the re-supply of the first transfer sheet 9 is finished, the rotating sheet re-supply roller 110 is lowered at a predetermined timing to supply a next (second) transfer sheet. The sheet re-supply roller 110 repeats such lifting and lowering movements.

The re-supplied transfer sheet 9 is conveyed by the pair of convey rollers 103 to reach the nip between the pair of regist rollers 104. After a predetermined loop is formed in the transfer sheet, the paired convey rollers 103 are stopped temporarily. Thereafter, the transfer sheet is conveyed to and adhered on the transfer material convey belt 7 at a predetermined timing, as is in the first surface image formation. Then, the transfer sheet is passed through the first to fourth image forming units Pa to Pd to form a second image on the other (second) surface of the transfer sheet. Then, the second image is fixed in the fixing device.

On the other hand, when the second image formation is started, since the first sheet deflection solenoid (not shown) is turned OFF, the transfer sheet on which the second image was formed and in which the second image was fixed is directed to a pair of discharge rollers, and then is discharged onto a discharge tray. After a last transfer sheet was discharged, the image forming operation is finished.

Image Process Portion

Figure 10A:
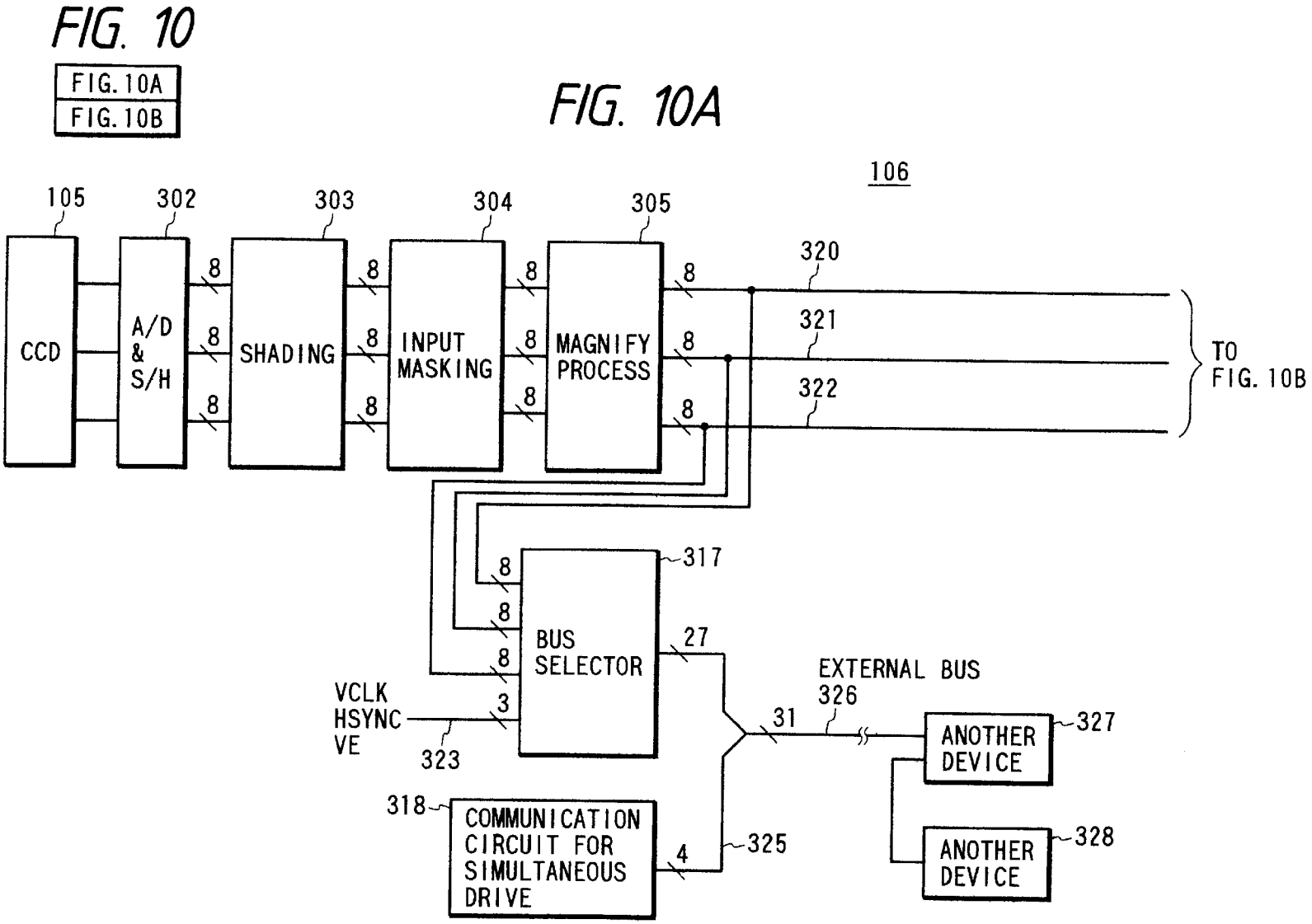
FIG. 10 is composed of FIGS. 10A and 10B illustrating explanatory views showing an image treatment circuit portion of the image forming apparatus of FIG. 4.
Figure 10B:
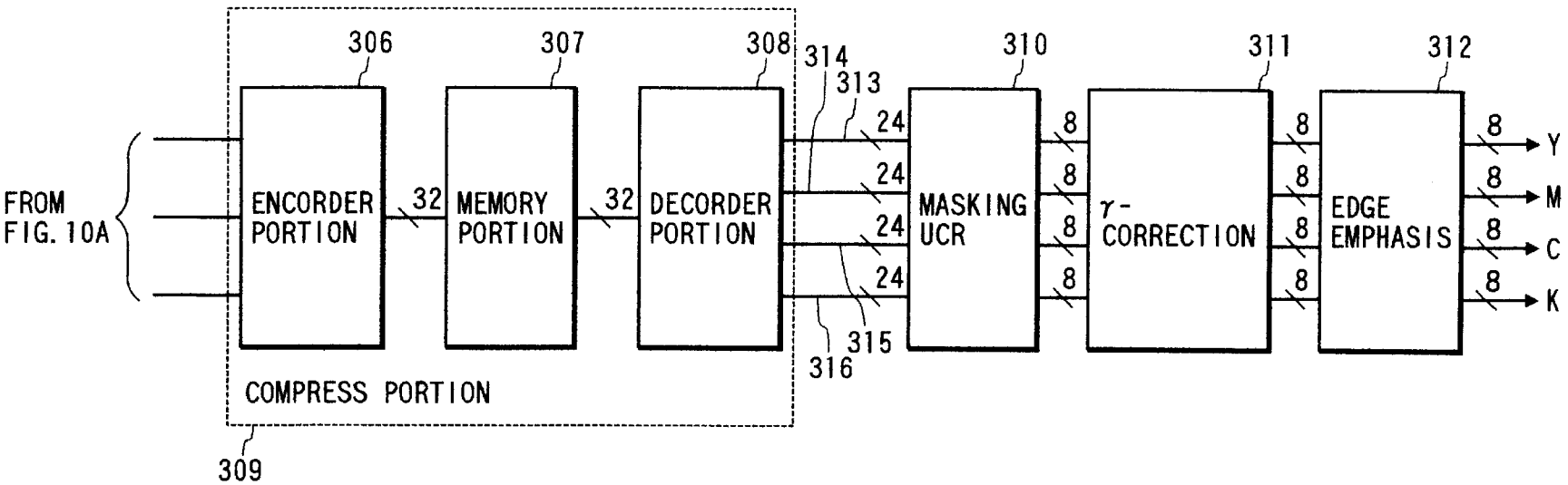

FIGS. 10A and 10B are explanatory views for explaining the construction of the image process portion shown in FIG. 4. Now, the construction and operation of the image process portion will be explained. Incidentally, FIGS. 10A and 10B show a flow of the image signal from the reading of the CCD 105 to the output as a print signal.

The image data photo-taken by the CCD 105 is sample-held by an A/D & S/H circuit 302. Then, the image data is A/D-converted to generate RGB three color digital signals. The color-decomposed data are subjected to shading correction and black correction in a shading circuit 303, and then are subjected to NTSC correction in an input masking circuit 304. Then, the data are subjected to magnify process (enlarge/contraction) in a magnify process circuit 305, and then are sent to an image data compress portion 309.

In the compress portion 309, the image is compressed by an encoder portion 306 for compressing the image data, and the compressed image data is stored in a memory portion 307. The image data compressed and stored in the memory portion 307 are read in an enlarged form by a decorder portion 308 to generate signals 313 to 316 corresponding to toner signals used in the printer. The read image data are subjected to pre-arrangement treatment and masking treatment in a masking UCR circuit 310 and then are γ-converted in a γ correction circuit 311, and then are subjected to edge emphasis in an edge emphasis circuit 312. Then, the data are sent to the printer portion.

Incidentally, in the illustrated embodiment, in order to achieve simultaneous drive function, there is provided a function for effecting signal-communication between the printer and external (another) devices.

When the signal is outputted to the another device, after the magnify process, signals 320 to 322 and signals 323 such as image synchronous signals VCLK, HSYNC, VE and the like are passed through a bus selector 317 and then are combined with a simultaneous drive control signal 325. The combined signal is sent to another device 327, 328 through an external bus 326. Further, when a signal is received from another device, the signal sent through the external bus 326 is introduced into the encoder portion 306 through the bus selector 317. A communicate circuit 318 for simultaneous drive utilizes four lines (communication lines and control lines) to effect communication between the circuit 318 and the external device(s), thereby achieving the synchronism of various sequences and communication of information.

Figure 11:
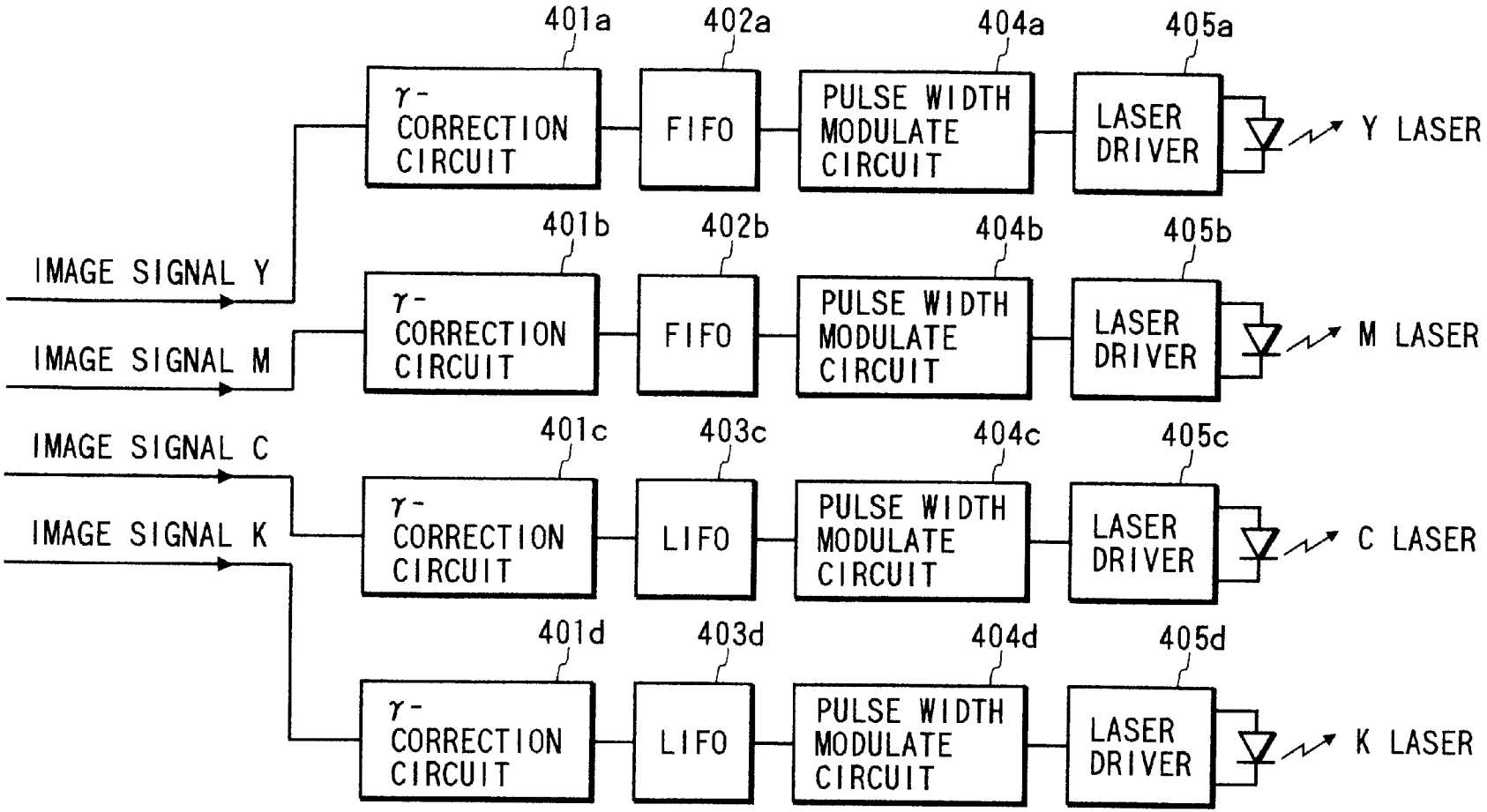
FIG. 11 is a block diagram for explaining an image data treating condition of a printer portion of the image forming apparatus of FIG. 4.

FIG. 11 is a block diagram for explaining the image data processing condition of the printer portion shown in FIG. 4.

The Y (yellow), M (magenta), C (cyan) and K (black) image signals sent from the reader portion are γ-corrected by γ-correction circuits 401*a*to 401*d* in accordance with sensitivity of the photosensitive drums. Thereafter, the image data Y and the image data M are synchronized with each other by FIFO circuits 402*a*, 402*b*. Regarding the image data C and the image data K, since they are scanned by the laser scanner 120 in a mirror-image fashion, main scan data thereof are inverted (reversely rotated) by LIFO circuits 403*a*, 403*b* to achieve the synchronism. Thereafter, the color image signals are pulse-width modulated by pulse width modulate circuits 404*a* to 404*d*. In response to the modulated image signals, laser drivers 405*a* to 405*d* are driven as lasers.

Image Synchronous Control

Figure 12:
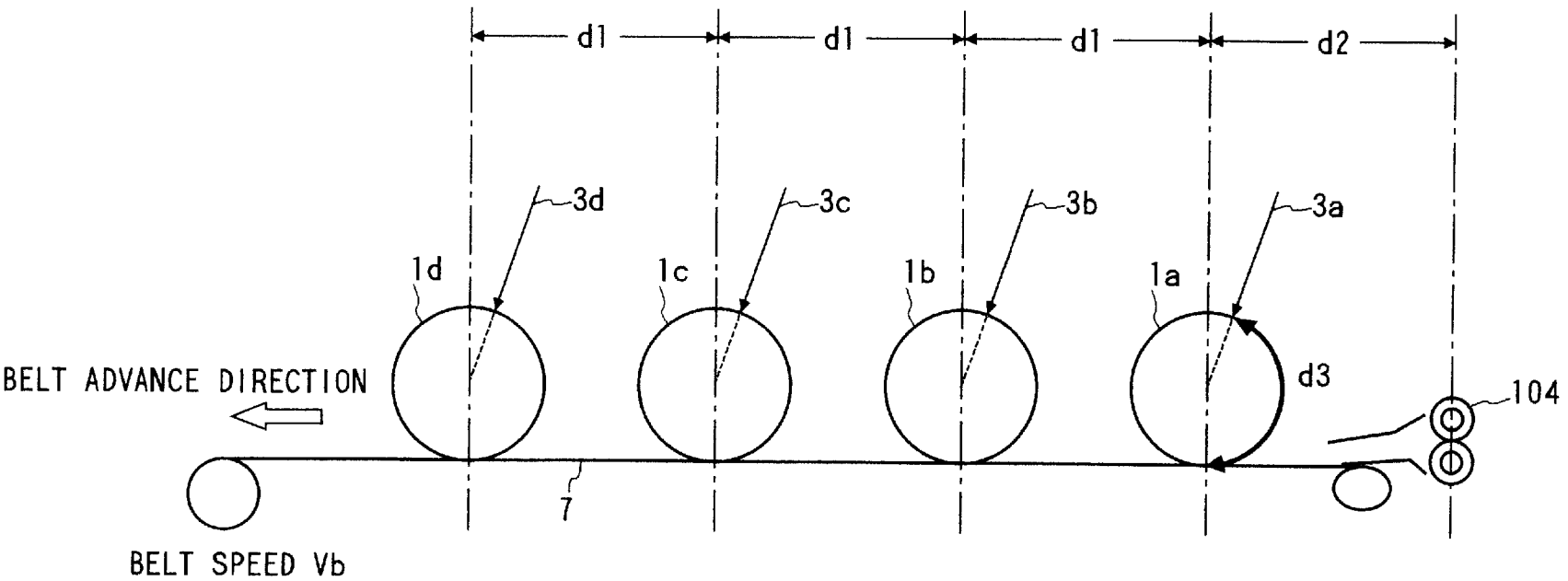
FIG. 12 is an explanatory view showing a positional relation between photosensitive drums in the printer portion of the image forming apparatus of FIG. 4.

FIG. 12 is a sectional view showing a positional relation between the photosensitive drums 1*a* to 1*d*of the printer portion.

As shown in FIG. 12, the photosensitive drums are disposed side by side with a distance d1, and the transfer material convey belt 7 conveys the transfer sheet 9 at a speed of Vb. By laser beams 3*a* to 3*d* in response to the image information for respective colors, the photosensitive drums are exposed by the image light beams corresponding to the respective colors. Now, it is assumed that a distance from an image exposure position on the Y (yellow) photosensitive drum and a contact position between the drum and the transfer material convey belt is d3 and a distance from the nip of the regist rollers 104 to a center of the Y photosensitive drum 1*a* is d2. Regarding this case, FIG. 13 shows exposure timings of sub-scans for exposing the photosensitive drums in such a manner that the image information of the original formed as the developed toner images are successively transferred onto the transfer sheet in a superimposed fashion when the transfer sheet passes through the yellow (Y), magenta (M), cyan (C) and black (K) image forming units.

Figure 13:
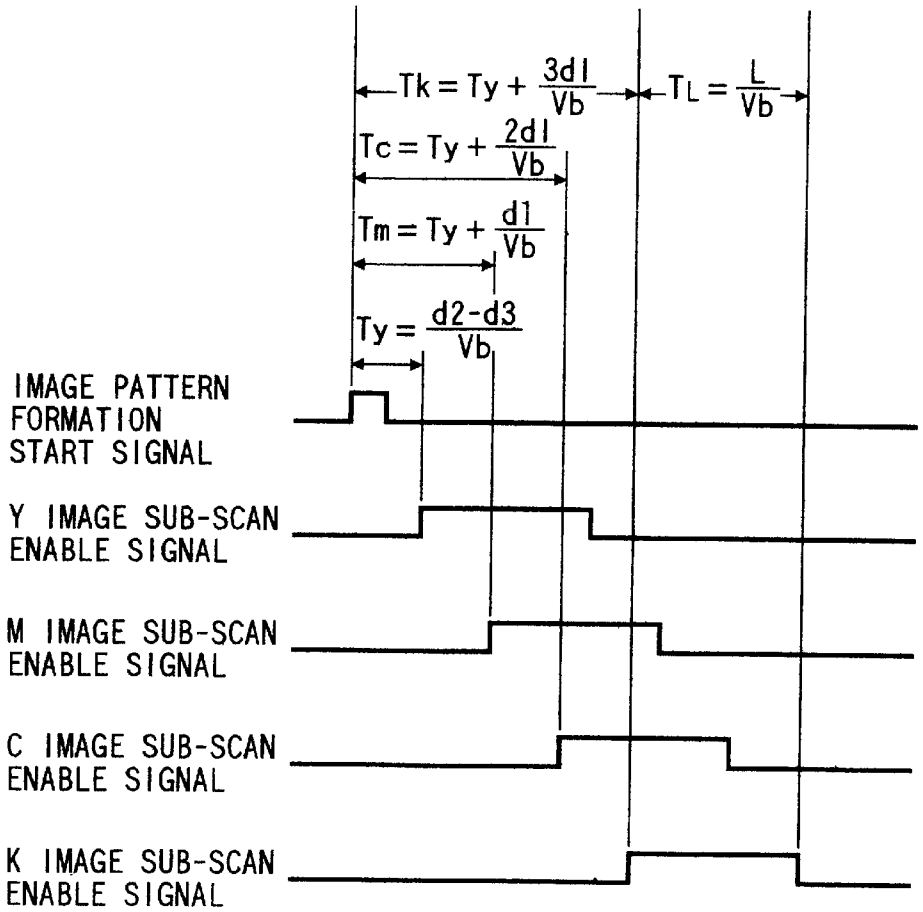
FIG. 13 is a timing chart showing exposure timings of sub-scans for exposing the photosensitive drums of FIG. 12.

FIG. 13 is a timing chart showing the exposure timings of sub-scans for exposing the photosensitive drums.

In order to send the transfer sheet stopped by the regist rollers 104 to the transfer material convey belt 7, an image pattern formation start signal is emitted at the same time when the regist rollers are driven. After the image pattern formation signal rises, enable signals (Y, M, C and K) rise at timings obtained from equations $$Ty=(d2-d3)/Vb,\ Tm=Ty+d1/Vb,\ Tc=Ty+2d1/Vb$$

and $$Tk=Ty+3d1/Vb,$$

respectively, and fall in accordance with a length of the transfer sheet in a sub-scan direction.

Figure 14:
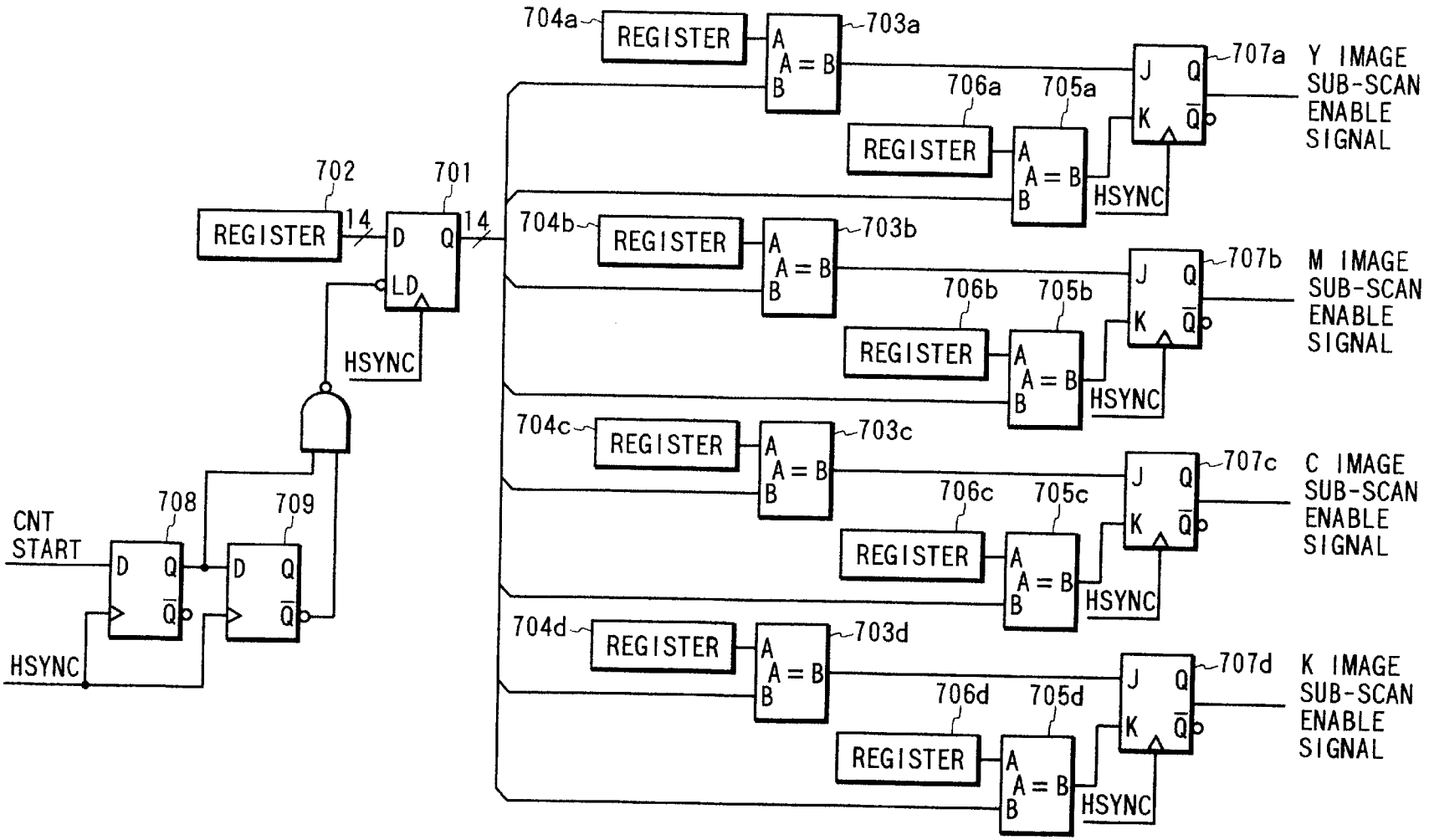
FIG. 14 is a block diagram showing an example of a circuit for generating sub-scan enable signals.

FIG. 14 is a block diagram showing an example of a circuit for generating the sub-scan enable signals shown in FIG. 13. Incidentally, in the illustrated embodiment, the time is counted by utilizing HSYNC in which one clock is generated whenever one-line is scanned. In FIG. 14, a 14-bit counter 701 serves to count the number of HSYNCs in synchronous with main scan synchronous HSYNC. A register 702 serve to store a value loaded in the counter when an LOAD signal is generated, and data is written in the register by a CPU (not shown). In the illustrated embodiment, data "0" is written.

Comparators 703*a* to 703*d* serve to compare rising times of color image enable signals with each other. The count numbers of HSYNCs corresponding to the enable signals Ty, Tm, Tc and Tk are written in registers 704*a* to 704*d* for defining the rising times of the color sub-scan enable signals by the CPU (not shown), and, when the count coincides with the output of the 14-bit counter 701, a coincidence signal is emitted.

Comparators 705*a* to 705*d* serve to compare falling times of color image enable signals with each other. The count numbers of HSYNCs corresponding to the enable signals Ty, Tm, Tc and Tk are written in registers 706*a* to 706*d* for defining the falling times of the color sub-scan enable signals by the CPU (not shown), and, when the count coincides with the output of the 14-bit counter 701, a coincidence signal is emitted. When the length of the transfer sheet is L, a time duration Tp during which the enable signal is risen is represented by Tp=L/Vb. Thus, values obtained by adding numerical values converted from Tp into HSYNC number to the values stored in the registers 704*a* to 704*d* are written in the registers 706*a* to 706*d*.

The image pattern formation start signal shown in FIG. 13 is inputted to an input CNT START of a flip-flop 708 shown in FIG. 14. The rising signal of the image pattern formation start signal is caught by two flip-flops 708, 709 and then is inputted to an input LOAD (LD) of the counter 701, thereby making the counter 701 clear for preparing the counting operation. The HSYNC numbers are successively counted by the counter 701. When the count value corresponding to the rise of the yellow (Y) enable signal is reached, the comparator 703*a* detects the coincidence and emits the coincidence signal.

The coincidence signal is inputted to a J terminal of a JK flip-flop 707*a*, so that the yellow (Y) sub-scan enable signal rises to an HI level. When the count is continued and the count value corresponding to the fall of the enable signal is reached, the comparator 705*a* detects the coincidence and emits the coincidence signal. The coincidence signal is inputted to a K terminal of a JK flip-flop 707*a*, so that the yellow (Y) sub-scan enable signal falls to a LOW level. Regarding magenta, cyan and black colors, sub-scan enable signals are generated in the same manner as the yellow sub-scan enable signal.

In the illustrated embodiment, the image forming apparatus has a simultaneous drive function for permitting the communication of image and/or information between devices by interconnecting a plurality of devices, so that an image scanned by a master device can be outputted from a slave device.

Figure 15:
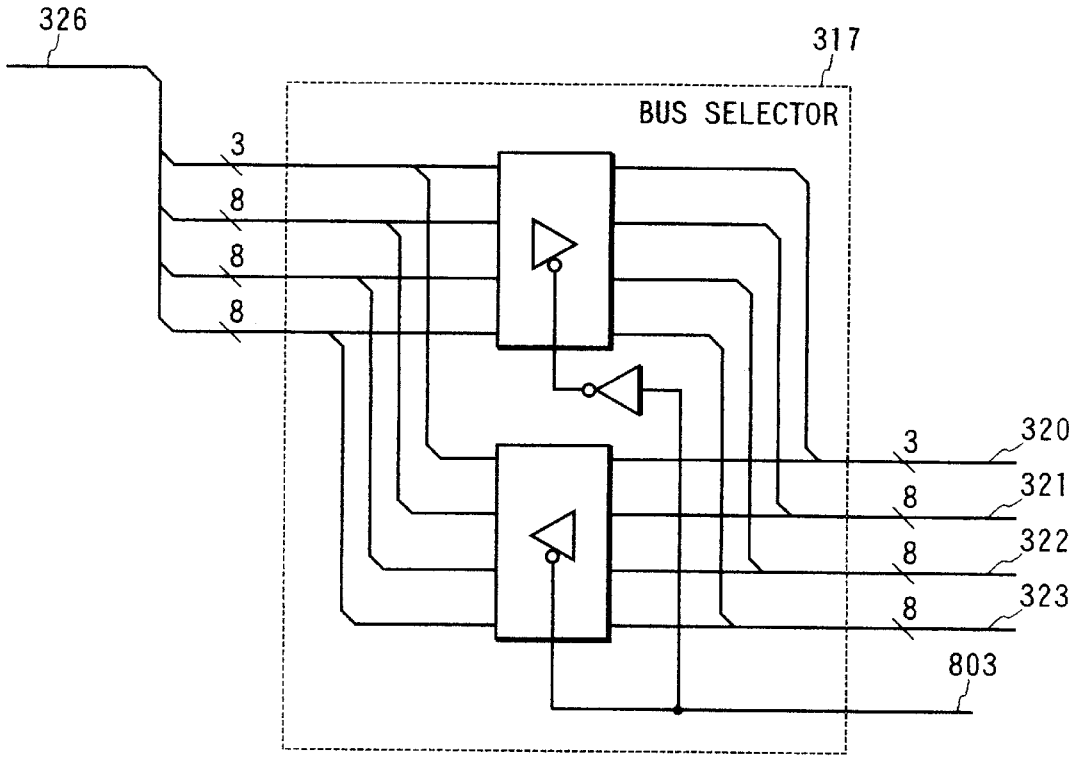
FIG. 15 is a block diagram of a bus selector shown in FIG. 12.

FIG. 15 is a block diagram for explaining the bus selector 317 shown in FIG. 10A. The bus selector 317 controls the flow of the image information between the devices on the basis of the image signal and image synchronous signal.

When any device is operated as a slave device under the control of the CPU (not shown), a signal line 803 is controlled to bring a signal on the line to an HI level so that the image signal and image synchronous signal can be inputted from outside to inside. On the other hand, when any device is operated as a master device, the signal on the line 803 is brought to a LOW level by the CPU so that the image signal and image synchronous signal can be inputted from inside to outside.

Belt Deflection Detection and Belt Deflection Control

Next, detection and control of the deflection of the transfer material convey belt will be explained.

Figure 1:
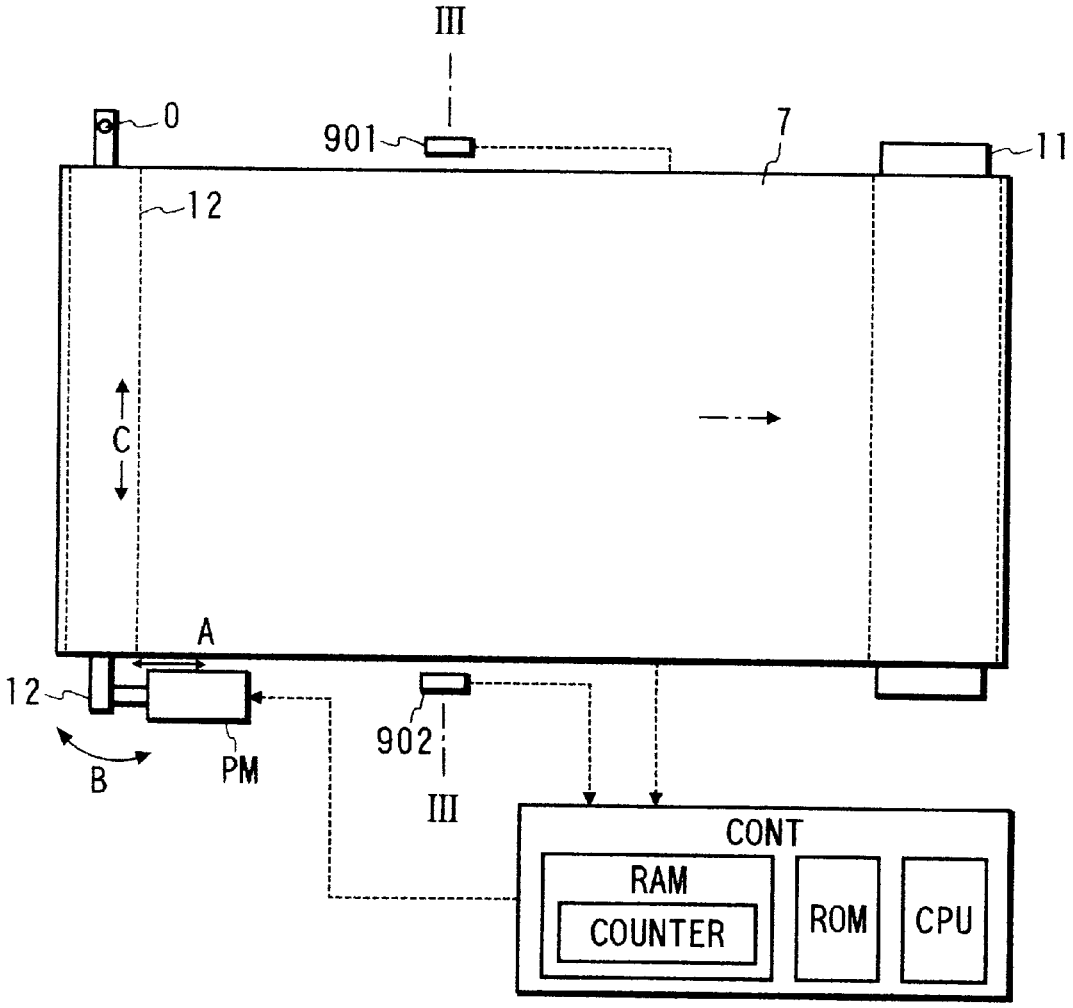
FIG. 1 is an explanatory view for explaining control for controlling offset or deflection of a transfer material convey belt, according to the present invention.

FIG. 1 is a plan view showing the transfer material convey belt 7 according to the present invention and therearound. In the illustrated embodiment, the transfer material convey belt 7 is mounted on and wound around a drive roller 11 disposed at a transfer sheet outlet end portion and an idler roller 12 disposed at a transfer sheet inlet end portion, and is subjected to tension by an adjustment roller 13. The image forming units Pa, Pb, Pc and Pd are successively disposed side by side from the transfer sheet inlet end portion to the transfer sheet outlet end portion between the idler roller 12 and the drive roller 11.

In the illustrated embodiment, the transfer material convey belt 7 is formed from material having low extension and which can transmit the rotation of the drive roller 11 efficiently and which does not greatly affect an influence upon transfer corona current in the transfer process. As shown in FIG. 14, a rotational force of a drive motor M is transmitted to the drive roller 11 to drive the transfer material convey belt 7 to a predetermined direction. Accordingly, it is preferable that an outer peripheral surface of the drive roller 11 is coated by rubber material having high coefficient of friction to apply a frictional conveying force to the transfer material convey belt 7.

On the other hand, as apparent from the aforementioned explanation, the adjustment roller 13 acts as a tensioner for the transfer material convey belt 7. To this end, both ends of the roller 13 are supported by springs (not shown) so that constant pressure can be applied to the transfer material convey belt 7.

Figure 2:
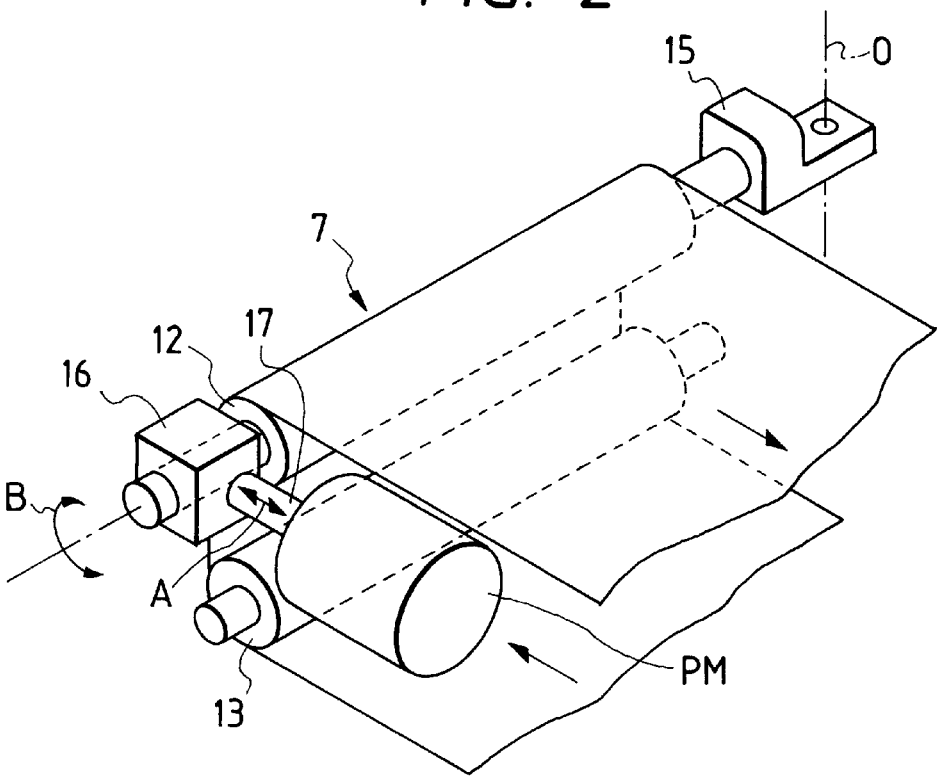
FIG. 2 is a perspective view belt deflection control means.

In the illustrated embodiment, as can be understood from FIG. 2, one shaft end of the idler roller 12 is rotatably supported by a bearing 15 which can be rotated around a rotation axis O, and the other shaft end is rotatably supported by a bearing 16. The bearing 16 can be driven by a pulse motor PM in a horizontal direction, i.e. a transfer sheet conveying direction (shown by the arrow A).

Explaining more in detail, the pulse motor PM acts as a moving means for moving the belt 7 in a direction C perpendicular to the transfer sheet conveying direction. To this end, a shaft 17 of the pulse motor PM is connected to the shaft end of the idler roller 12 via the bearing 16. When a length of the shaft 17 is changed by driving the pulse motor PM, the idler roller 12 is rotated around the rotation axis O in directions shown by the arrow B. By changing the inclination angle of the idler roller 12 for conveying the transfer material convey belt 7, it is possible to change a conveying direction of the belt 7. Incidentally, the symbol CONT denotes a control portion including a CPU, a ROM and a RAM.

According to the illustrated embodiment, sensors (detection means) 901, 902 for detecting lateral edges of the belt to detect the belt deflection are disposed adjacent to the lateral edges of the belt 7. Now, the sensor disposed at a front side of the apparatus is called a belt front end detection sensor 901 and the sensor disposed at a rear side of the apparatus is called a belt rear end detection sensor 902.

Figure 3:
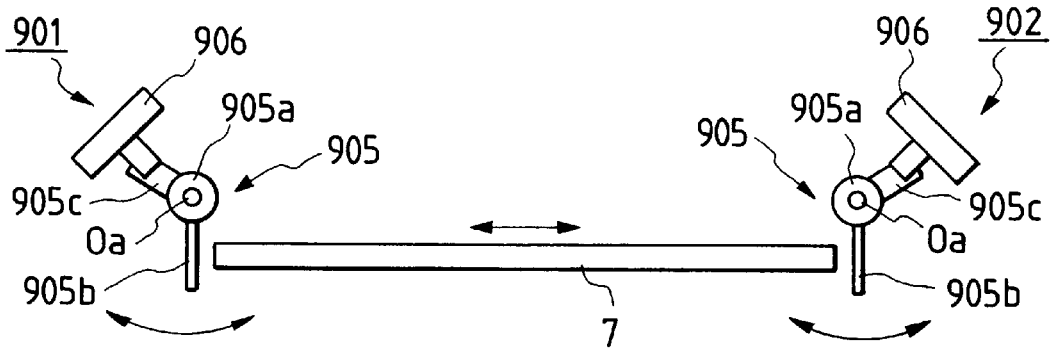
FIG. 3 is a sectional view taken along the line III—III in FIG. 1, showing a belt deflection detection means.

FIG. 3 shows the belt front end detection sensor 901 and the belt rear end detection sensor 902 in detail. The detection sensors 901, 902 have the same (identical) construction, and, each sensor includes an actuator 905 and a photo-interrupter 906. The actuator 905 has a support shaft 905*a* rotatable around a center Oa, an operation piece 905*b* attached to the support shaft 905*a* and extending to a position adjacent to the lateral edge of the belt and operated by the lateral edge of the belt, and a light shield plate 905*c* integrally attached to the support shaft 905*a* and moved integrally with the operation piece 905*b* when the latter is operated by the lateral edge of the belt.

In the illustrated embodiment, for example, if the transfer material convey belt 7 toward the front side of the image forming apparatus, the operation piece 905*b* of the actuator 905 of the belt front end detection sensor 901 is urged by the lateral edge of the belt. As a result, the light shield plate 905*c* enters into the photo-interrupter 906, thereby detecting the deflection of the belt. On the other hand, if the transfer material convey belt 7 toward the rear side of the image forming apparatus, similarly, the belt rear end detection sensor 902 is operated to detect the deflection of the belt.

Embodiment 1

Belt Deflection Control Algorithm

Figure 6:
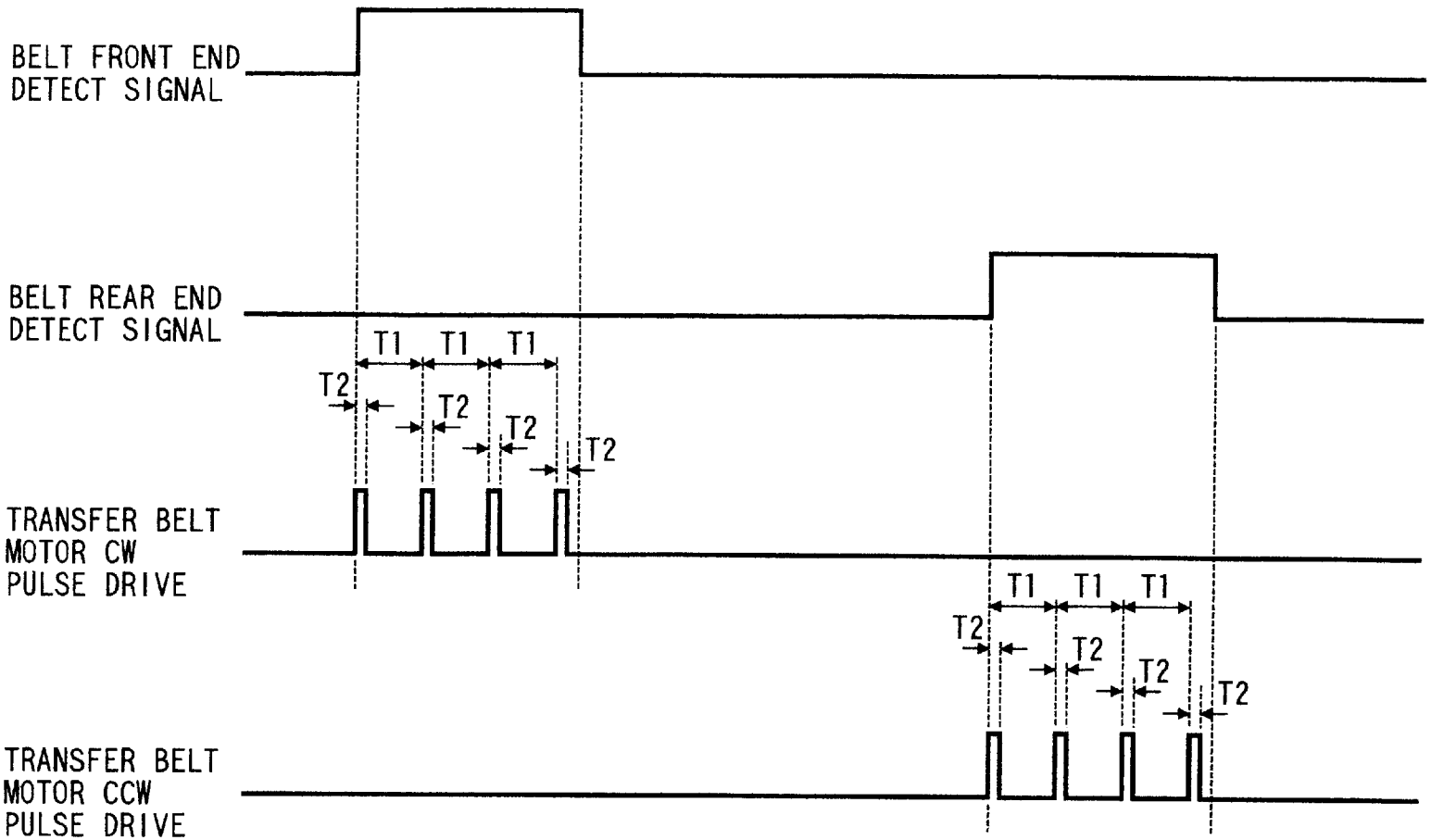
FIG. 6 is an explanatory view showing a control timing chart for belt deflection control.

Now, the belt deflection control algorithm will be explained. FIG. 6 shows the detection of the ends (edges) of the belt and the transfer material convey belt driving condition.

In the illustrated embodiment, when the front end of the belt 7 is detected by the belt front end detection sensor 901, a belt front end detect signal is brought to a HI level. When the front end detect signal is emitted from the sensor 901, the CPU judges whether the belt front end is detected by the sensor 901 every predetermined time period (T1). If the belt end is detected, the pulse motor PM is rotated in a clockwise (CW) direction for a time period T2 not affecting an influence upon the image. Similarly, when the rear end of the belt 7 is detected by the belt rear end detection sensor 902, a belt rear end detect signal is brought to a HI level. When the rear end detect signal is emitted from the sensor 902, the CPU judges whether the belt rear end is detected by the sensor 902 every predetermined time period (T1). If the belt end is detected, the pulse motor PM is rotated in a counter-clockwise (CCW) direction for the time period T2 not affecting an influence upon the image.

Figure 7:
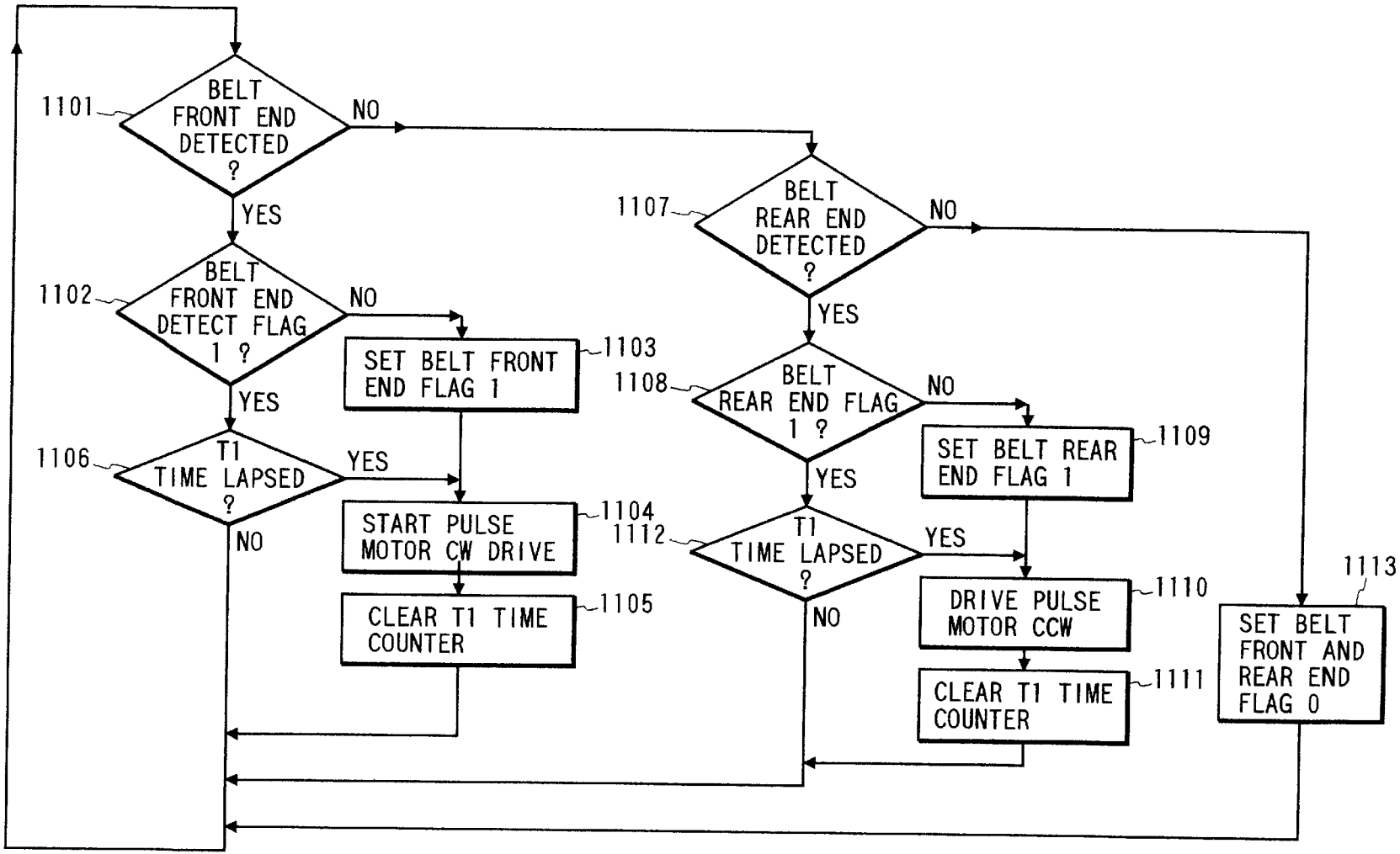
FIG. 7 is a flow chart for explaining control algorithm for the belt deflection control.

FIG. 7 is a flow chart of the belt deflection control algorithm. The CPU judges whether the front end of the belt 7 is detected by the belt front end detection sensor 901 (step 1101), and, if the belt front end is detected, it is judged whether the belt deflection is being controlled or not, i.e., a belt front end detection flag is "1" or not (step 1102). If the belt front end detection flag is "0", it means that the front end is detected from a central position of the belt, and, in this condition, the belt front end detection flag is set to "1" (step 1103). Then, after the pulse motor PM starts to be driven, a T1 time counter is cleared (step 1105).

In the step 1102, if the belt front end detection flag is "1", it means that the belt front end is being detected. In this case, it is judged whether the counter cleared in the step 1105 elapses or exceeds the T1 time (step 1106). If the T1 time is elapsed, the program goes to a step 1104, where the pulse motor PM is driven. If the counter does not exceed the T1 time, the program is returned to the step 1101.

In the step 1101, if the belt front end is not detected, it is judged whether the rear end of the belt is detected by the belt rear end detection sensor 902 (step 1107). If the rear end of the belt is not detected, it is judged whether a belt rear end detection flag is "1" or not (step 1108). If the belt rear end detection flag is "0", it means that the rear end is detected from the central position of the belt, and, in this condition, the belt rear end detection flag is set to "1" (step 1109). Then, the pulse motor PM is driven in the counter-clockwise direction for Pccw pulses (step 1110). Then, after the pulse motor PM starts to be driven, the T1 time counter is cleared (step 1111).

In the step 1108, if the belt rear end detection flag is "1", it means that the belt rear end is being detected. In this case, it is judged whether the counter cleared in the step 1111 elapses or exceeds the T1 time (step 1112). If the T1 time is elapsed, the program goes to a step 1110, where the pulse motor PM is driven. If the counter does not exceed the T1 time, the program is returned to the step 1101. In the step 1107, if the belt rear end is not detected, since the belt is positioned centrally, the belt front and rear end detection flags are cleared to "0". Although the times T1, T2 can be set appropriately, when the belt conveying speed is 8 mm/sec, the good result could be obtained by setting T1=5000 msec and T2=266 msec.

Embodiment 2

In the embodiment 1, while an example that the number of drive pulses of the pulse motor PM is constant regardless of the conveying direction of the transfer material convey belt 7 was explained, in the embodiment 2, in consideration of the fact that deflection speeds of the transfer material convey belt 7 toward front and rear sides are different from each other due to a mechanical factor, the number of drive pulses in the belt front end detection (due to deflection) is differentiated from the number of drive pulses in the belt rear end detection (due to deflection).

Figure 8:
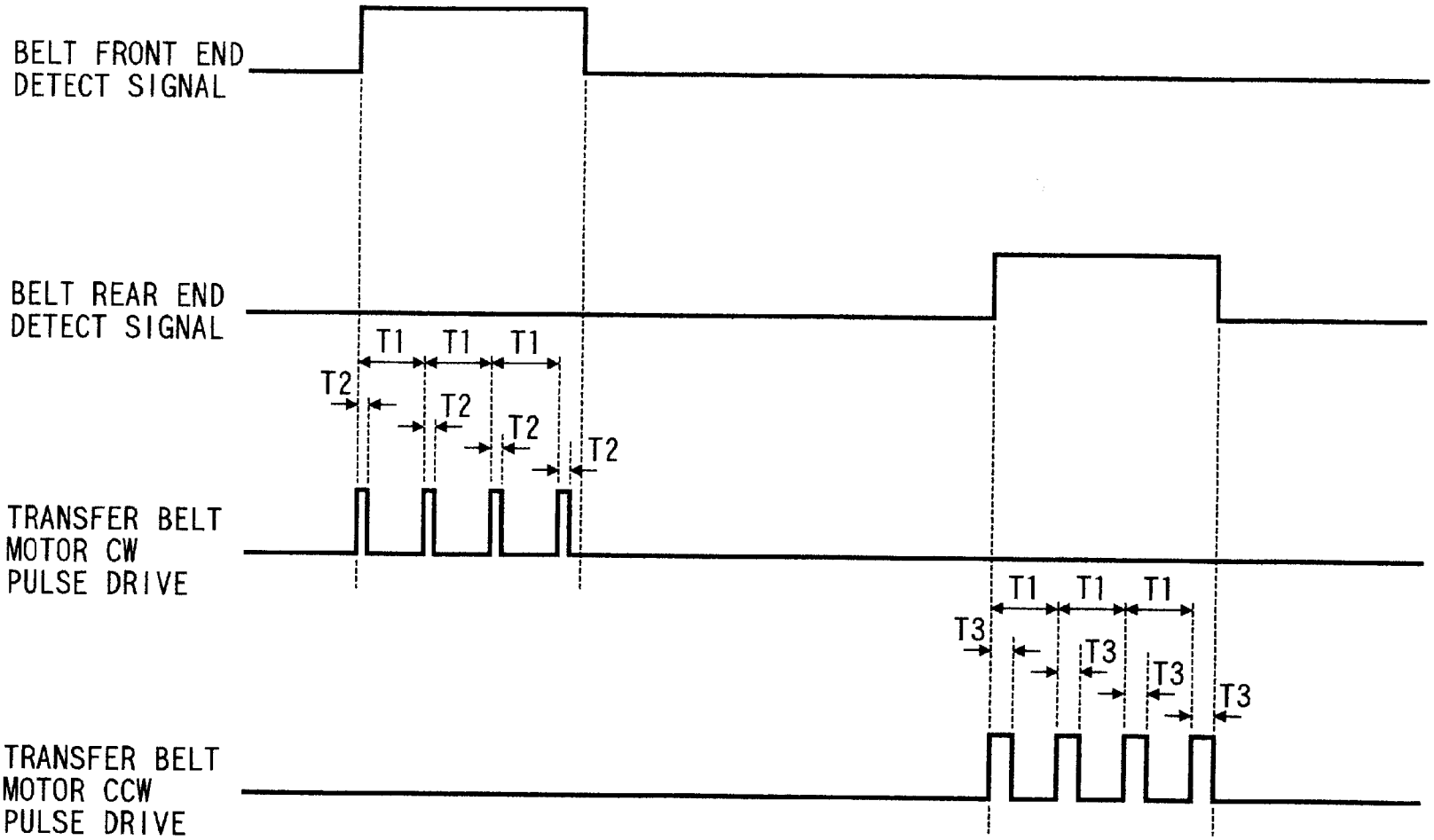
FIG. 8 is an explanatory view showing a control timing chart for belt deflection control, according to another embodiment.

FIG. 8 shows the detection of the ends (edges) of the belt and the transfer material convey belt driving condition, in the embodiment 2.

According to the embodiment 2, if the front end of the belt 7 is detected by the belt front end detection sensor 901, the pulse motor PM is driven in the clockwise direction for the time period T2 not affecting an influence upon the image; whereas, if the rear end of the belt 7 is detected by the belt rear end detection sensor 902, the pulse motor PM is driven in the counter-clockwise direction for a time period T3 not affecting an influence upon the image.

Although the times T1, T2 and T3 can be set appropriately, when the belt conveying speed is 8 mm/sec, the good result could be obtained by setting T1=5000 msec, T2=266 msec and T3=300 msec.

Embodiment 3

In the above-mentioned embodiments, while an example that the belt deflection control is effected constantly regardless of the rocking (shifting) speeds of the belt in the directions C was explained, in the embodiment 3, the belt shifting control is effected in accordance with the shifting speed of the belt in the directions C.

Belt Deflection Time Measurement

Figure 16:
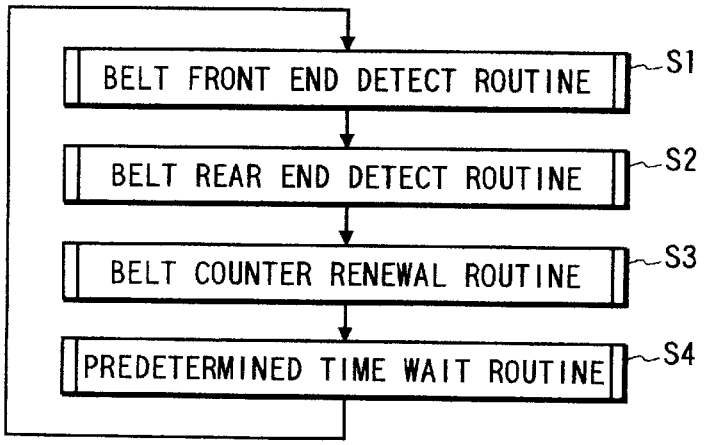
FIG. 16 is a flow chart showing measuring and treating a belt deflection time in the image forming apparatus according to the present invention.

FIG. 16 is a flow chart showing a program for measuring a belt deflection time in an image forming apparatus according to this embodiment. The belt deflection time measuring program generally includes four routines, i.e., (1) belt front end detect routine, (2) belt rear end detect routine, (3) belt counter renewal routine, and (4) predetermined time wait routine.

Figure 17:
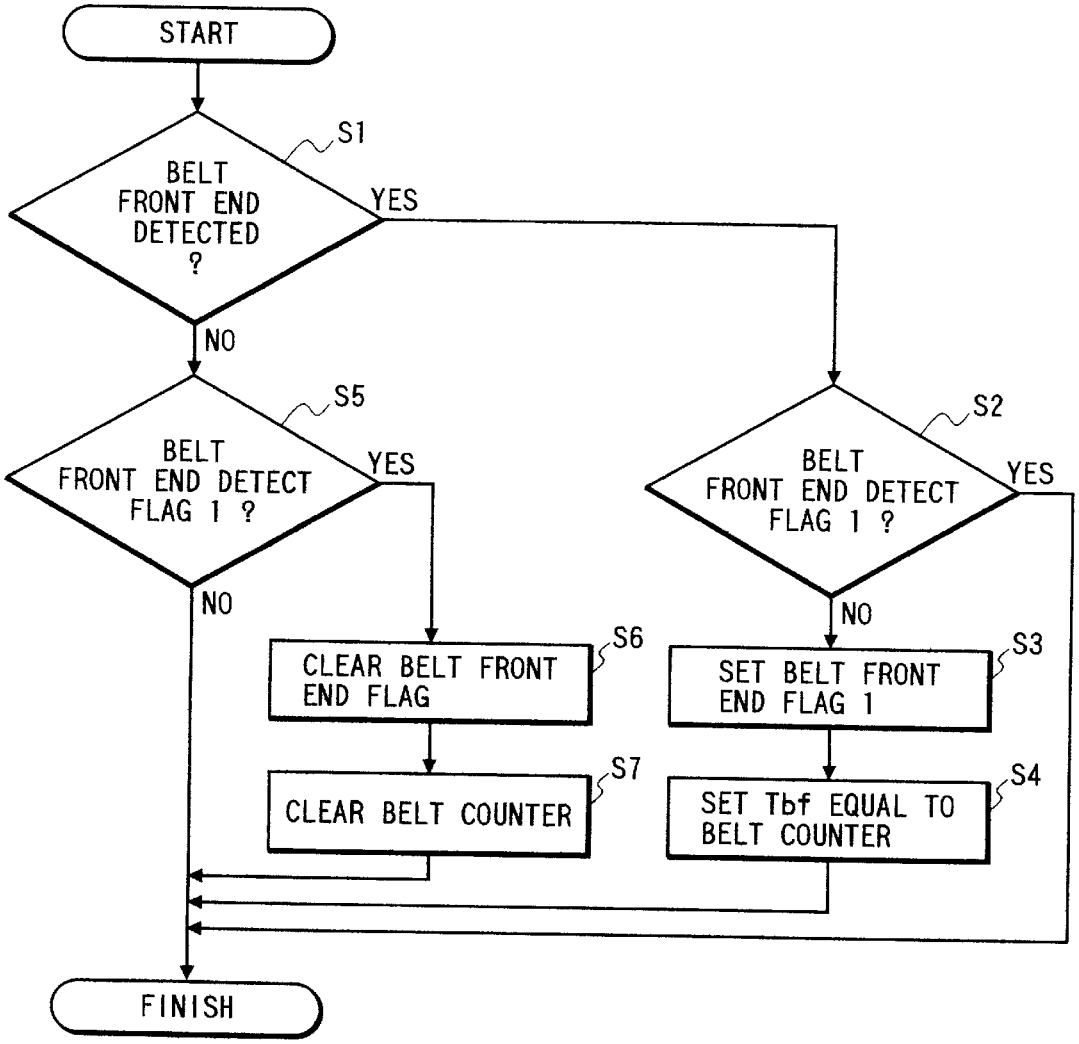
FIG. 17 is a flow chart showing a belt front end detect routine shown in FIG. 16 in detail.

FIG. 17 is a flow chart showing the belt front end detect routine shown in FIG. 16 in detail.

In FIG. 17, it is judged whether the belt is detected by the belt front end detection sensor 901 (step S1). If the convey belt 7 is detected by the sensor, it is judged whether the belt front end detection flag is "1" or not (step S2). If the belt front end detection flag is "1", meaning that the detection of the belt front end previously, the routine is ended as it is.

On the other hand, in the step S2, if it is judged that the belt front end detection flag is "0", meaning that the belt is deflected from the centered position toward the sensor 901, the belt front end detection flag is set to "1" (step S3), and a value of the belt counter is set to Tbf (step S4).

In the step S1, if it is judged that the belt front end is not detected by the sensor 901, it is judged whether the belt front end detection flag is "1" (step S5). If the belt front end detection flag is "1", meaning that the belt is being shifted from the front side toward the centered position, the belt front end detection flag is set to "0" (step S6), and the belt counter is cleared to "0" (step S7).

Figure 18:
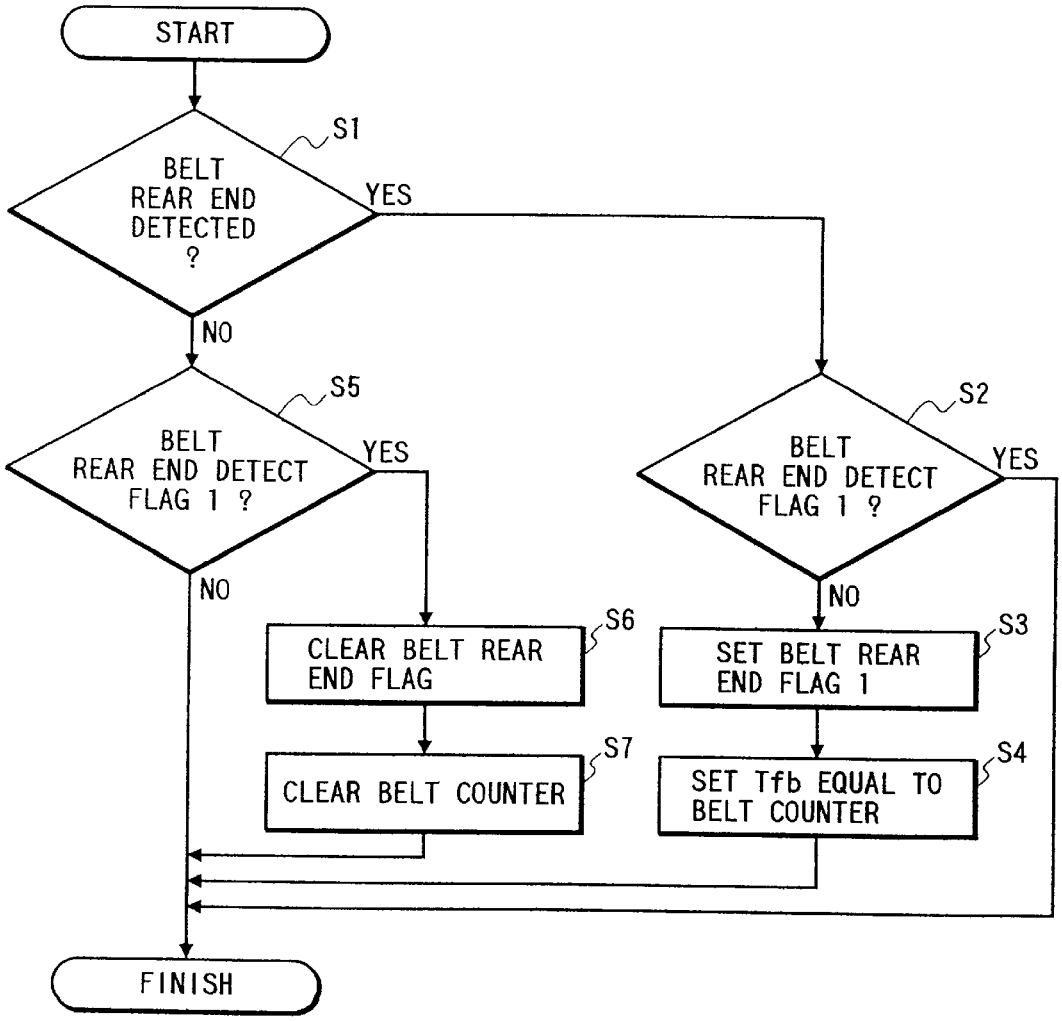
FIG. 18 is a flow chart showing a belt rear end detect routine shown in FIG. 16 in detail.

FIG. 18 is a flow chart showing the belt rear end detect routine shown in FIG. 16 in detail.

In FIG. 18, it is judged whether the belt is detected by the belt rear end detection sensor 902 (step S1). If the convey belt is detected by the sensor, it is judged whether the belt rear end detection flag is "1" or not (step S2). If the belt rear end detection flag is "0", since it means that the belt is deflected from the centered position toward the sensor 902, the belt rear end detection flag is set to "1" (step S3) and the value of the belt counter is set to Tfb (step S4).

On the other hand, in the step S1, if it is judged that the belt rear end is not detected by the sensor 902, it is judged whether the belt rear end detection flag is "1" (step S5). If the belt rear end detection flag is "1", since it means that the belt is being shifted from the rear side toward the centered position, the belt rear end detection flag is set to "0" (step S6), and the belt counter is cleared to "0" (step S7).

Incidentally, the belt counter renewal routine shown in FIG. 16 serves to advance the counter value by one, and the predetermined time wait routine is a time waiting routine, and, according to the illustrated embodiment, in this routine, a waiting time is set so that the steps S1 to S3 are repeated every 100 msec.

Figure 19:
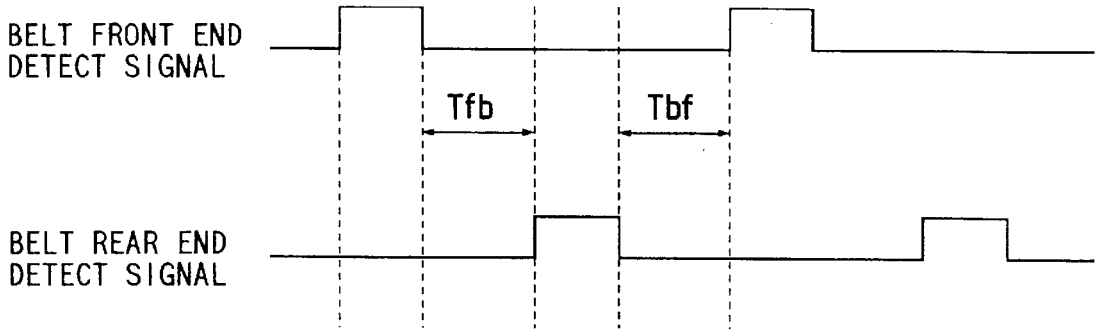
FIG. 19 is a timing chart showing timings of sensor detection signals when the sensors are monitored by the algorithm shown in FIG. 17, a time when the belt is shifted from a front side to a rear side, and a time when the belt is shifted from the rear side to the front side.

FIG. 19 is a timing chart showing the sensor detection signal conditions when the sensor conditions are monitored by the algorithm shown in FIG. 17 and FIG. 18 and timings of the time duration Tbf during which the belt is shifted from the front side to the rear side and the time duration Tbf during which the belt is shifted from the rear side to the front side. That is to say, the time duration Tbf corresponds to the speed of the belt being shifted from the front side to the rear side and the time duration Tbf corresponds to the speed of the belt being shifted from the rear side to the front side.

Belt Deflection Control Algorithm

The total number P of drive pulses of a belt shift pulse motor required for switching the shifting direction of the belt is calculated on the basis of the detected shifting time durations Tfb, Tbf in the following manner. When the belt shifting time is long, i.e. when the shifting speed is slow (T>Tth), P=Pinit; whereas, when the belt shift time is short, i.e. when the shifting speed is high (T≦Tth), P=C(Tth−T)+Pinit. In this way, the number of pulses for driving the pulse motor to switch the belt rocking direction is set so that the pulse number when the shifting speed is high becomes greater than the pulse number when the shifting speed is slow.

Where, C is constant, Tth is a threshold time derived from a shifting time design average value of the belt, and T is a detected belt shifting time (Tfb or Tfb) wherein Tfb is used when the belt is being shifted from the front side to the rear side (upper side to lower side in FIG. 1) and Tbf is used when the belt is being shifted from the rear side to the front side. Further, Tinit (predetermined number of pulses driven every time) means the number of pulses driven when the detected time T is smaller than Tth and is previously determined in consideration of the feature of the apparatus.

Figure 20:
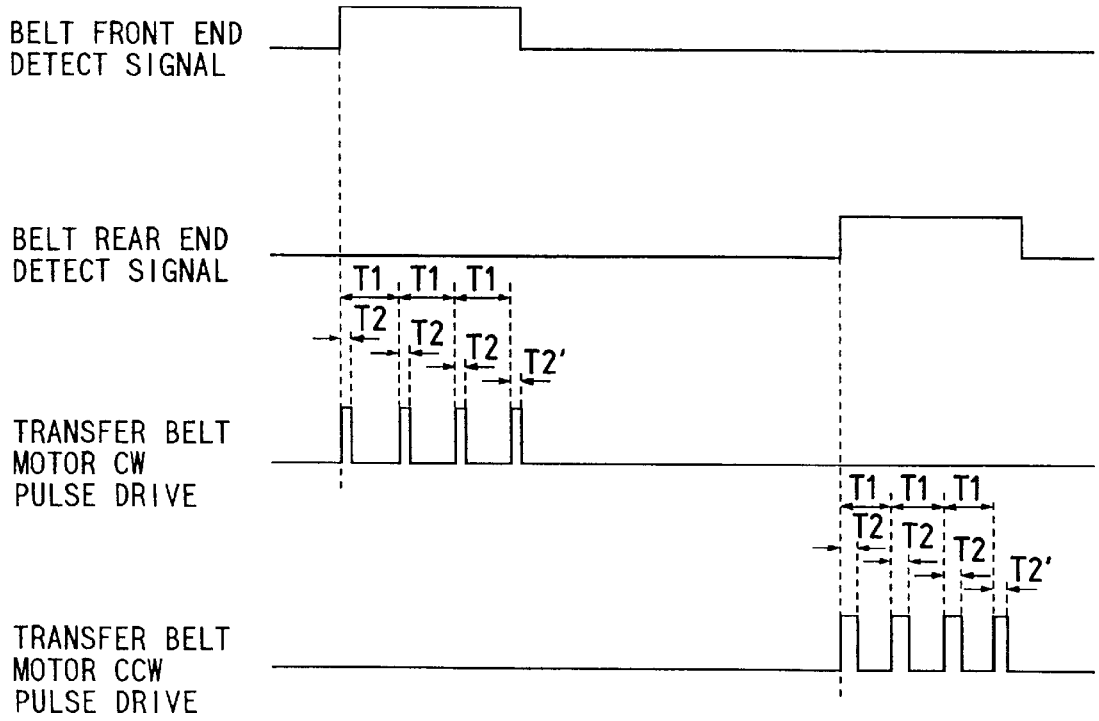
FIG. 20 is a timing chart showing belt end detection timings and transfer belt drive timing in the belt deflection control of the image forming apparatus according to the present invention.

FIG. 20 is a timing chart showing the belt end detections and drive timings of the belt. When the front end of the belt is detected by the belt front end detection sensor 901, the belt front end detect signal is brought to a HI level. When the belt front end detect signal from the sensor 901 is detected, the CPU judges whether the belt is detected by the sensor every predetermined time period (T1). If the belt end is detected, a pulse motor 903 is rotated in a clockwise (CW) direction for a time period T2 not affecting an influence upon the image. This is repeated until the total driving time is reached.

Similarly, when the rear end of the belt 7 is detected by the belt rear end detection sensor 902, a belt rear end detect signal is brought to a HI level. When the rear end detect signal is detected, the CPU judges whether the belt rear end is detected by the sensor 902 every predetermined time period (T1). If the belt end is detected, the pulse motor is rotated in a counter-clockwise (CCW) direction for the time period T2 not affecting an influence upon the image. This is repeated until the total driving time is reached. When the number of pulses corresponding to the time period T2 is Pt2, the pulse motor is driven by N times. Where, N=(P/Pt2) and P is the total number of drive pulses. Incidentally, N is integral number.

Incidentally, when the number of pulses does not reach the time period T2, the number of pulses corresponding to the remaining time period T2' is driven.

Figure 21:
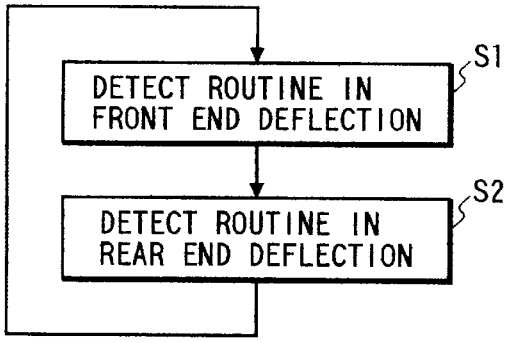
FIG. 21 is a flow chart showing an embodiment of a belt deflection control method of the image forming apparatus according to the present invention.

FIG. 21 is a flow chart showing an embodiment of a belt deflection controlling method in the image forming apparatus. First of all, a detect routine in front end deflection is executed (step S1), and then, a detect routine in rear end deflection is executed (step S2).

Figure 22:
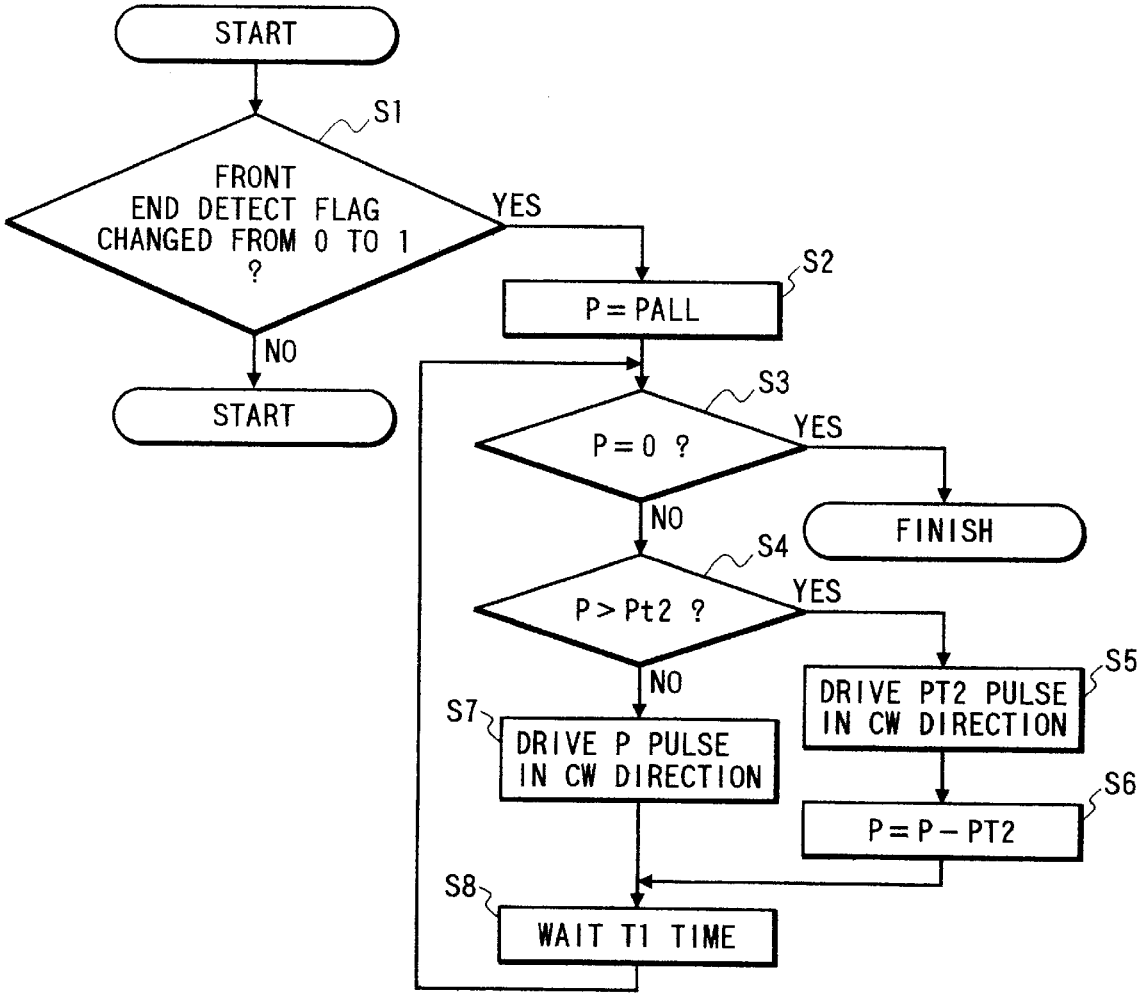
FIG. 22 is a flow chart showing a belt rocking control sequence regarding the front end deflection shown in FIG. 21.

FIG. 22 is a flow chart showing a belt shifting control sequence in the front end deflection shown in FIG. 21.

First of all, the CPU monitors whether the belt front end detection flag (described in connection with the algorithm for measuring the belt deflection time) is changed from "0" to "1" (step S1). If changed, since it means that belt is shifted from the centered position toward the front side, in this condition, the total number PALL of drive pulses calculated as mentioned above is set to P (step S2). It is judged whether P is not "0" (step S3), and, if P is not "0", it is judged whether P is greater than Pt2 (step S4). If P is greater than Pt2, the pulse motor is driven in the clockwise direction by Pt2 pulses (step S5), and P is subtracted by Pt2 (step S6).

On the other hand, if Pt2 is greater than P, the pulse motor is driven in the clockwise direction by P pulses (step S7). Thereafter, Ti time waiting is effected (step S8), and the above process is repeated until it is judged that P is "0" in the step S3.

Figure 23:
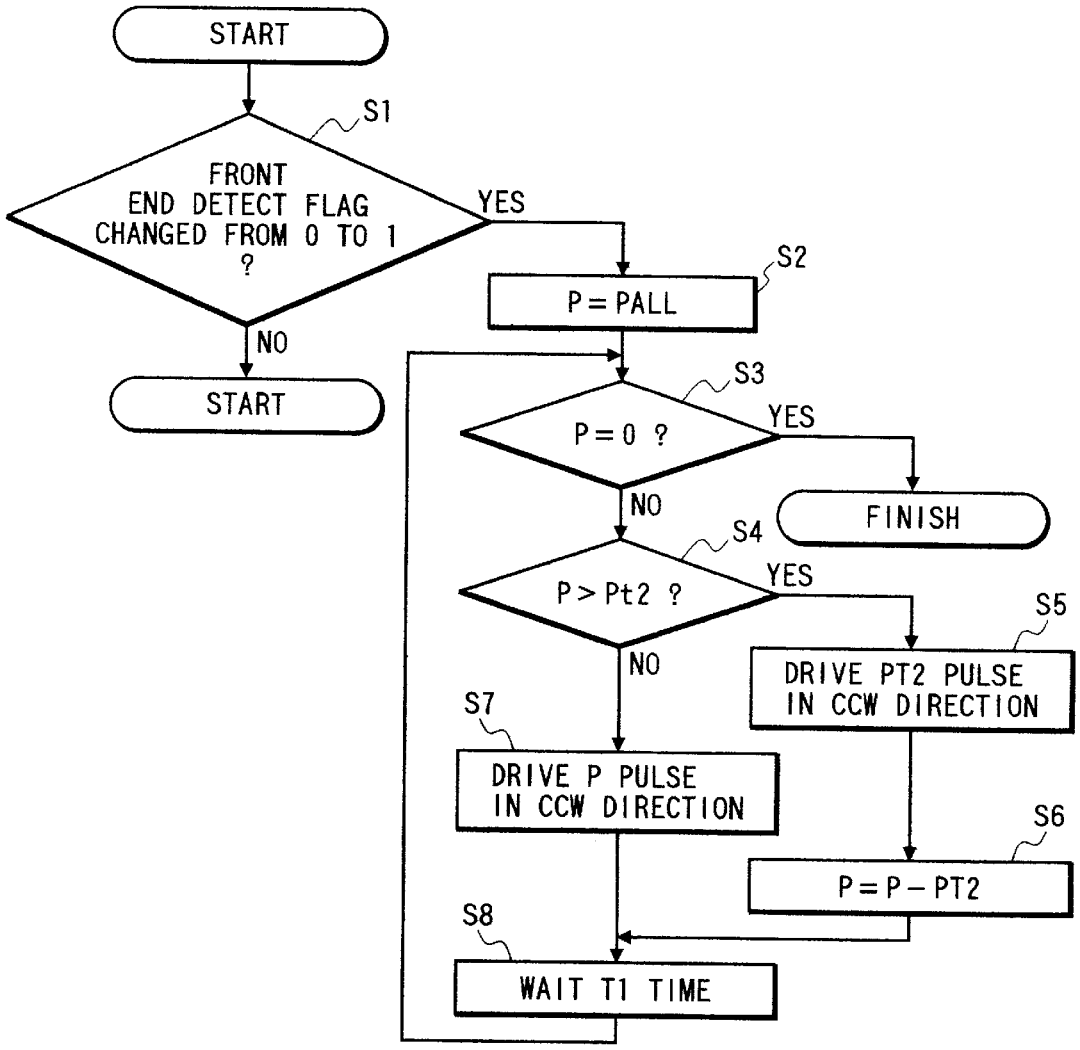
FIG. 23 is a flow chart showing a belt shifted control sequence regarding the rear end deflection shown in FIG. 21.

FIG. 23 is a flow chart showing a belt shifting control sequence in the rear end deflection shown in FIG. 21. First of all, the CPU monitors whether the belt rear end detection flag (described in connection with the algorithm for measuring the belt deflection time) is changed from "0" to "1" (step S1). If changed, since it means that belt is shifted from the centered position toward the rear side, in this condition, the total number PALL of drive pulses calculated as mentioned above is set to P (step S2). It is judged whether P is "0" (step S3), and, if P is not "0", it is judged whether P is greater than Pt2 (step S4). If P is greater than Pt2, the pulse motor is driven in the counter-clockwise direction by Pt2 pulses (step S5). And, P is subtracted by Pt2 (step S6). On the other hand, if Pt2 is greater than P, the pulse motor is driven in the counter-clockwise direction by P pulses (step S7). Thereafter, Ti time waiting is effected (step S8), and the above process is repeated until it is judged that P is "0" in the step S3.

According to the illustrated embodiment, there are provided the shifting drive means (pulse motor PM) for shifting the idler roller 12 associated with the belt by the predetermined amount, the plurality of detection means (detection sensors 901, 902) for detecting the deflection of the belt shifted in the direction perpendicular to the belt conveying direction, the counting means (counter in the control portion CONT) for effecting the counting operation in accordance with the outputs of the detection means, the calculating means (CPU in the control portion CONT) for calculating the total number of drive pulses of the shift drive means on the basis of the counted value counted by the counting means, and the control means (CPU in the control portion CONT) for driving the shifting drive means successively by the number of pulses (obtained by dividing the total number of drive pulses by the predetermined number of pulses). And, by counting the shift time corresponding to the belt shifting speed by the counter with the aid of the plural detection sensors 901, 902 for detecting the deflection condition of the belt shifted in the direction perpendicular to the belt conveying direction, by calculating the total number of drive pulses of the pulse motor PM by the CPU on the basis of the counted value, and, by driving the pulse motor PM successively under the control of the CPU by the number of pulses (obtained by dividing the total number of drive pulses by the predetermined number of pulses), the deflected belt can be gradually shifted to the normal position while preventing the abrupt movement of the belt which may occur the deterioration of the image.

The control means (CPU in the control portion CONT) serves to drive the pulse motor PM successively by the number of pulses (obtained by dividing the total number of drive pulses by the predetermined number of pulses) while the belt deflection condition is being detected by the sensor 901 or 902, and to drive the shifting drive means for the predetermined time period by several times. The counting means serves to count the shift time from the completion of detection of the belt deflection condition by the one of the sensors to the initiation detection of the belt deflection condition by the other sensor, thereby surely determining the shift speed of the belt and to permit the calculation of the total number of drive pulses of the shift drive means.

In other words, by carrying out a transfer deflection (deviation) correcting method comprising a detection step (steps S1 in FIGS. 17 and 18) for detecting the deflection condition of the belt member (convey belt 7) shifted in the direction perpendicular to the belt conveying direction by means of the detection portion (detection sensors 901, 902), a counting step (steps S4 in FIGS. 17 and 18) for counting the time duration during which the deflection condition is being detected, a deriving step (steps S2 in FIGS. 17 and 18) for deriving the total shifting time duration during which the shifting shaft (idler roller) of the belt member is moved to correct the deflection condition on the basis of the counted value, and a shifting step (steps S4 to S7 in FIGS. 22 and 23) for shifting the shaft of the belt member for the time duration obtained by dividing the derived total shifting time duration by the predetermined time duration, by several times, it is possible to automatically return the deflected belt member to the correct or normal position gradually without abrupt shifting of the belt which may cause the deterioration of the image.

In the above-mentioned embodiment, regarding the calculation of the total number of drive pulses of the pulse motor, while an example that the total number of pulses is calculated from the above-mentioned equation only when the shifting speed of the belt is slow was explained, the present invention is not limited to such an example, but, for example, another equation may be prepared when the shifting speed of the belt is slow or other calculating equations may be used to determine the total number of pulses.

According to the illustrated embodiment, since the total drive amount is calculated on the basis of the belt shifting time duration when the belt deflection is detected and the belt deflection is controlled by driving the pulse motor by several times for the total number of drive pulses in total, the belt deflection can be corrected while preventing the deterioration of the image due to the abrupt change in the shifting direction of the belt.

The present invention is not limited to the above-mentioned embodiments, but various alterations and modifications can be adopted within the scope of the invention.

What is claimed is:

1. An image forming apparatus comprising:

a convey belt for bearing a recording material thereon to convey it;

support means for supporting said convey belt;

image forming means for forming an image on the recording material born on said convey belt;

detection means for detecting a position of said convey belt in a lateral direction thereof;

moving means for moving said convey belt in the lateral direction thereof by changing a position of said support means; and control means for controlling a number of moving operations performed by said moving means, based on a detected output of said detection means, to change a moving direction of said convey belt in the lateral direction thereof, wherein when the moving direction of said convey belt is changed in the lateral direction, said control means performs a plural number of the moving operations by said moving means in a manner that each of the moving operations is performed each time a first time period is elapsed, and then said control means ceases the moving operations of said moving means for a second time period which is longer than the first time period, thereafter performing a next moving operation.

2. An image forming apparatus according to claim 1, wherein said control means controls the number of moving operations performed by said moving means corresponding to a time period in which said convey belt is moved a predetermined distance in the lateral direction.

3. An image forming apparatus according to claim 1, wherein said detection means comprises a first sensor disposed in the vicinity of one end of said convey belt in the direction perpendicular to the conveying direction of recording material, and a second sensor disposed in the vicinity of the other end of said convey belt in the same direction.

4. An image forming apparatus according to claim 2, wherein said detection means comprises a first sensor disposed in the vicinity of one end of said convey belt in the direction perpendicular to the conveying direction of recording material, and a second sensor disposed in the vicinity of the other end of said convey belt in the same direction; and said image forming apparatus further comprising:

a count means for counting a time from when the detection of said convey belt by said first sensor is finished to when the detection of said convey belt by said second sensor is started.

5. An image forming apparatus according to claim 1, wherein said moving means moves a shaft for supporting said convey belt.

6. An image forming apparatus according to claim 1 or 5, wherein said moving means includes a pulse motor.

7. An image forming apparatus according to claim 1, wherein said control means controls said moving means so that a number of the moving operations when the time period is greater than a predetermined value is larger than that when the time period is below the predetermined value.

8. An image forming apparatus according to claim 1, wherein said image forming means includes an image bearing member, and a transfer means for transferring the image from said image bearing member to the recording material born on said convey belt.

9. An image forming apparatus according to claim 1, wherein said image forming means includes a plurality of image bearing members, and transfer means for transferring the image from said plural image bearing members to the recording material born on said convey belt in a superimposed fashion.

10. An image forming apparatus according to claim 8 or 9, wherein said image bearing member is an electrophotographic photosensitive member.

11. An image forming apparatus according to claim 1, wherein said image forming means forms the image on the recording material born on said convey belt, irrespective of change of said support means position.

12. An image forming apparatus according to claim 1, wherein said control means performs a plural number of moving operations in a manner that each of the moving operations is performed each time the first time period is elapsed, and then said control means ceases the moving operations of said moving means for the second time period which is longer than the first time period, thereafter performing another plural number of the moving operations in a manner that each of the moving operations is performed each time the first time period is elapsed.

13. An image forming apparatus according to claim 1, wherein said control means calculates a total number of moving operations of said moving means based on the output of said detection means in order to change the moving direction of said convey belt in the lateral direction.

14. An image forming apparatus according to claim 13, wherein said control means performs the plural number of said moving operations each of which is performed each time the first time period is elapsed, and each time the second time period is elapsed, until the moving operations performed by the moving means amounts to the total number.

15. An image forming apparatus comprising:

a convey belt for bearing a recording material thereon to convey it;

image forming means for forming an image on the recording material born on said convey belt;

moving means for moving said convey belt in a lateral direction;

count means for counting a time period in which said convey belt is moved by a predetermined distance in the lateral direction; and control means for controlling a moving operation of said convey belt by said moving means corresponding to the time period counted by said count means.

16. An image forming apparatus according to claim 15, wherein said moving means moves a shaft for supporting said convey belt.

17. An image forming apparatus according to claim 15 or 16, wherein said moving means includes a pulse motor.

18. An image forming apparatus according to claim 15, wherein said control means controls said moving means so that a number of the moving operations when the time period is greater than a predetermined value is larger than that when the time period is below the predetermined value.

19. An image forming apparatus according to claim 15, wherein said image forming means includes an image bearing member, and a transfer means for transferring the image from said image bearing member to the recording material born on said convey belt.

20. An image forming apparatus according to claim 15, wherein said image forming means includes a plurality of image bearing members, and transfer means for transferring the images from said plural image bearing members to the recording material born on said convey belt in a superimposed fashion.

21. An image forming apparatus according to claim 19 or 20, wherein said image bearing member is an electrophotographic photosensitive member.

22. An image forming apparatus according to claim 15, wherein said image forming means forms the image on the recording material born on said convey belt, irrespective of movement of said convey belt in the lateral direction.

23. An image forming apparatus according to claim 15, further comprising detection means for detecting a position of said convey belt in the lateral direction.

24. An image forming apparatus according to claim 23, wherein said detection means comprises a first sensor disposed in the vicinity of one end of said convey belt in the lateral direction and a second sensor disposed in the vicinity of the other end of said convey belt in the same direction.

25. An image forming apparatus according to claim 23, wherein said detection means includes a first sensor disposed in the vicinity of one end of said convey belt in the lateral direction and a second sensor disposed in the vicinity of the other end of said convey belt in the same direction; and wherein said count means counts the time period from when the detection of said convey belt by said first sensor is finished to when the detection of said convey belt by said second sensor is started.

26. An image forming apparatus comprising:

a convey belt for bearing a recording material thereon to convey it;

image forming means for forming an image on the recording material born on said convey belt;

moving means for moving said convey belt in a lateral direction thereof; and control means for controlling a moving operation of said convey belt by said moving means in accordance with a moving speed of said convey belt in the lateral direction.

27. An image forming apparatus according to claim 26, further comprising detection means for detecting a position of said convey belt in the lateral direction.

28. An image forming apparatus according to claim 27, wherein said detection means comprises a first sensor disposed in the vicinity of one end of said convey belt in the lateral direction, and a second sensor disposed in the vicinity of the other end of said convey belt in the same direction.

29. An image forming apparatus according to claim 26, wherein said moving means moves a shaft for supporting said convey belt.

30. An image forming apparatus according to claim 26 or 29, wherein said moving means includes a pulse motor.

31. An image forming apparatus according to claim 26, wherein said control means controls so as to make a number of the moving operations performed by said moving means greater in case that the moving speed is higher than a predetermined value as compared with that in case that the moving speed is lower than the predetermined value.

32. An image forming apparatus according to claim 26, wherein said image forming means includes an image bearing member and transfer means for transferring the image from said image bearing member to the recording material born on said convey belt.

33. An image forming apparatus according to claim 26, wherein said image forming means includes a plurality of image bearing members and transfer means for transferring the images from said plurality of image bearing members to the recording material born on said convey belt in a superimposed fashion.

34. An image forming apparatus according to claim 32 or 33, wherein said image bearing member is an electrophotographic photosensitive member.

35. An image forming apparatus according to claim 26, wherein said image forming means forms the image on the recording material born on said convey belt, irrespective of movement of said convey belt in the lateral direction.

* * * * *

UNITED STATES PATENT AND TRADEMARK OFFICE

CERTIFICATE OF CORRECTION

PATENT NO. : 6,141,525

DATED : October 31, 2000

INVENTOR(S): MOTOAKI TAHARA

It is certified that error appears in the above-identified patent and that said Letters Patent is hereby corrected as shown below:

COLUMN 1:
Line 17, "a" should read --an--.
Line 37, "3ato" should read --3a to--.

COLUMN 4:
Line 11, "an" should read --a--.

COLUMN 5:
Line 23, "an" should read --a--.
Line 26, "an" should read --a--.

COLUMN 7:
Line 35, "the another" should read --another--.

COLUMN 10:
Line 9, "rotated" should read --moved, shifted or rocked--.
Line 15, "for" should read --for shifting or--.
Line 20, "rotated" should read --moved or shifted--.

COLUMN 13:
Line 22, "rocking" should read --shifting--.

COLUMN 14:
Line 47, "shift" should read --shifting--.
Line 53, "shift" should read --shifting--.

UNITED STATES PATENT AND TRADEMARK OFFICE

CERTIFICATE OF CORRECTION

PATENT NO. : 6,141, 525

DATED : October 21, 2000

INVENTOR(S): MOTOAKI TAHARA

It is certified that error appears in the above-identified patent and that said Letters Patent is hereby corrected as shown below:

COLUMN 15:

Line 6, "shift" should read --shifting--.
Line 7, "by the" should read --by--.
Line 11, "shift" should read --shifting--.
Line 22, "moved" should read --shifted--.

Signed and Sealed this

First Day of May, 2001

*Attest:*

Nicholas P. Godici

NICHOLAS P. GODICI

*Attesting Officer*

*Acting Director of the United States Patent and Trademark Office*